US009608338B2

(12) United States Patent
Terashima et al.

(10) Patent No.: US 9,608,338 B2
(45) Date of Patent: Mar. 28, 2017

(54) CYLINDRICAL BODY, CRIMP TERMINAL, AND MANUFACTURING METHOD THEREOF, AS WELL AS MANUFACTURING APPARATUS OF CRIMP TERMINAL

(71) Applicants: FURUKAWA ELECTRIC CO., LTD., Tokyo (JP); FURUKAWA AUTOMOTIVE SYSTEMS INC., Shiga (JP)

(72) Inventors: Ryusuke Terashima, Shiga (JP); Mikio Kuwabara, Shiga (JP); Kentaro Sakamoto, Shiga (JP)

(73) Assignees: FURUKAWA ELECTRONIC CO., LTD., Toyko (JP); FURUKAWA AUTOMOTIVE SYSTEMS, INC., Shiga (JP)

( * ) Notice: Subject to any disclaimer, the term of this patent is extended or adjusted under 35 U.S.C. 154(b) by 0 days.

(21) Appl. No.: 14/832,682

(22) Filed: Aug. 21, 2015

(65) Prior Publication Data

US 2016/0006135 A1 Jan. 7, 2016

Related U.S. Application Data

(63) Continuation of application No. PCT/JP2014/050324, filed on Jan. 10, 2014.

(30) Foreign Application Priority Data

Feb. 23, 2013 (JP) ..... 2013-034026
Jun. 13, 2013 (JP) ..... 2013-124354

(51) Int. Cl.
*H01R 4/18* (2006.01)
*H01R 13/52* (2006.01)
(Continued)

(52) U.S. Cl.
CPC ..... *H01R 4/183* (2013.01); *H01R 4/187* (2013.01); *H01R 13/5221* (2013.01); *H01R 4/62* (2013.01); *H01R 43/048* (2013.01)

(58) Field of Classification Search
CPC ..... H01R 4/183; H01R 4/187; H01R 13/5221
(Continued)

(56) References Cited

U.S. PATENT DOCUMENTS 3,955,044 A * 5/1976 Hoffman ..... H01R 4/62 174/84 C
4,076,988 A * 2/1978 Litz ..... H02K 55/04 310/10
(Continued)

FOREIGN PATENT DOCUMENTS

JP 06-302341 A 10/1994
JP 08-017544 A 1/1996
(Continued)

OTHER PUBLICATIONS

English Translation of the International Search Report issued Apr. 15, 2014 in PCT/JP2014/050324 filed Jan. 1, 2014.
(Continued)

*Primary Examiner* — Timothy Thompson
*Assistant Examiner* — Charles Pizzuto
(74) *Attorney, Agent, or Firm* — Oblon, McClelland, Maier & Neustadt, L.L.P.

(57) ABSTRACT

Following the cylindrical bend processing of the shape crimping portion corresponding part corresponding to the crimping section in the sheet-shaped terminal base material, the high bending-rate processing process of bend processing at a bending rate higher than a bending rate for plastically deforming at least a part of a deformation portion to be plastically deformed in a predetermined bend processing shape in the crimping portion corresponding part, and the
(Continued)

shaping process of shaping the crimping portion corresponding part into the cylindrical crimping section are performed in this order.

12 Claims, 24 Drawing Sheets

(51) Int. Cl.
*H01R 4/62* (2006.01)
*H01R 43/048* (2006.01)

(58) Field of Classification Search
USPC ..... 174/72 A; 439/877; 428/587, 364
See application file for complete search history.

(56) References Cited

U.S. PATENT DOCUMENTS

| | | | | |
|---|---|---|---|---|
| 7,137,854 | B2 * | 11/2006 | Casses | H01R 13/113 439/852 |
| 2002/0034898 | A1 * | 3/2002 | Kuwayama | H01R 4/185 439/877 |
| 2008/0254673 | A1 * | 10/2008 | Noda | H01R 4/185 439/430 |
| 2009/0186507 | A1 * | 7/2009 | Watanabe | H01R 4/185 439/282 |
| 2013/0040509 | A1 * | 2/2013 | Mitose | H01R 4/185 439/877 |
| 2013/0130569 | A1 * | 5/2013 | Sato | H01R 4/206 439/882 |
| 2013/0252488 | A1 * | 9/2013 | Ito | H01R 4/188 439/877 |
| 2013/0273790 | A1 * | 10/2013 | Jakoplic | H01R 13/17 439/891 |

FOREIGN PATENT DOCUMENTS

| | | | |
|---|---|---|---|
| JP | 2003-025026 | A | 1/2003 |
| JP | 2004-071437 | A | 3/2004 |
| JP | 2004-071439 | A | 3/2004 |
| JP | 2008-262842 | A | 10/2008 |
| JP | 2006-293693 | A | 12/2008 |
| JP | 2008-293693 | A | 12/2008 |
| JP | 2009-176536 | A | 8/2009 |
| JP | 2009-245701 | A | 10/2009 |
| JP | 2009-301839 | A | 12/2009 |
| JP | 2010-055874 | A | 3/2010 |
| JP | 2010-198789 | A | 9/2010 |
| JP | 2013-196832 | A | 9/2013 |
| JP | 2014164868 | * | 9/2014 |

OTHER PUBLICATIONS

First Office Action issued in Chinese Patent Application No. 201480010054.4 dated Dec. 5, 2016.
Notification of Reason for Refuseal issued in Korean Patent Application No. 10-2015-7023622 dated Dec. 12, 2016.

* cited by examiner

FIG. 3B1
FIG. 3B2
FIG. 3B3
FIG. 3C1
FIG. 3C2
FIG. 3C3
10A, 10
300A
Ltb
Lt
Ltf
Du
D
Wt
Lcu
Lc
Lcd
Wc
300
310
320
60A
40A
20A
50A
25A
240A
241A
21
22A
23A
24A
A
B
C

FIG. 4B1
FIG. 4B2
FIG. 4B3
FIG. 4C1
FIG. 4C2
FIG. 4C3
Lc
Lcu
Lcd
Ltb
Lt
Ltf
Wt
Du
D
E
F
152
50A
40A
60A
241
240
241A
240A
21
22
22A
23
23A
24
25
25A
20
10A, 10

FIG. 11A1
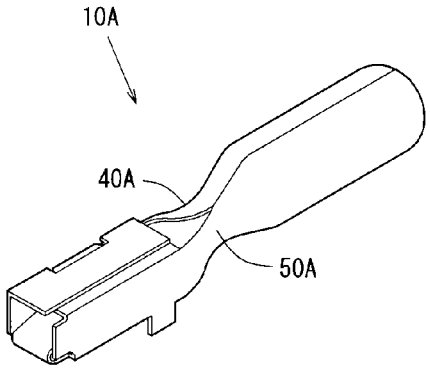
FIG. 11B1
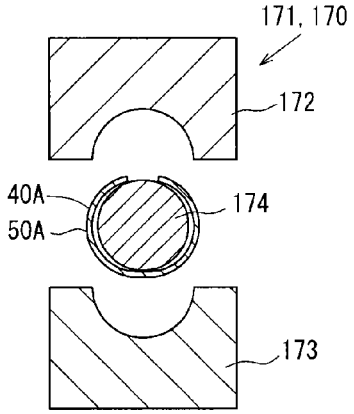
FIG. 11A2
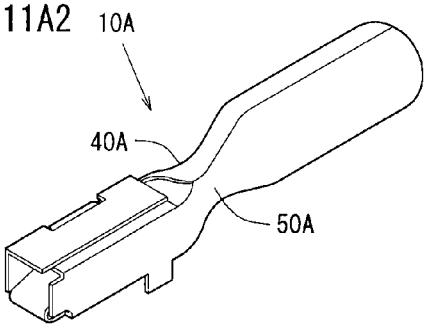
FIG. 11B2
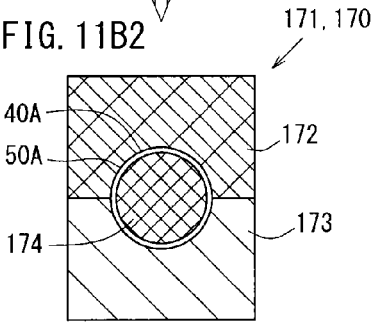

FIG. 12A1
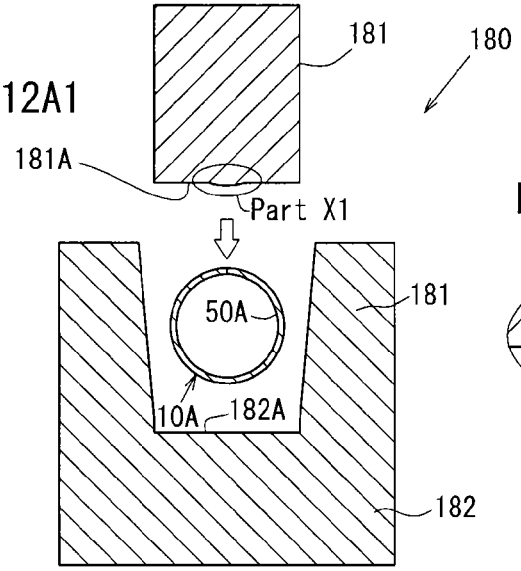
FIG. 12A2
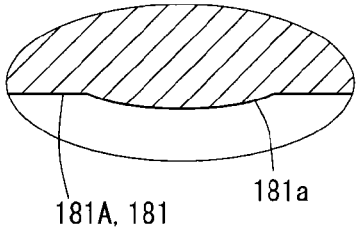
FIG. 12B1
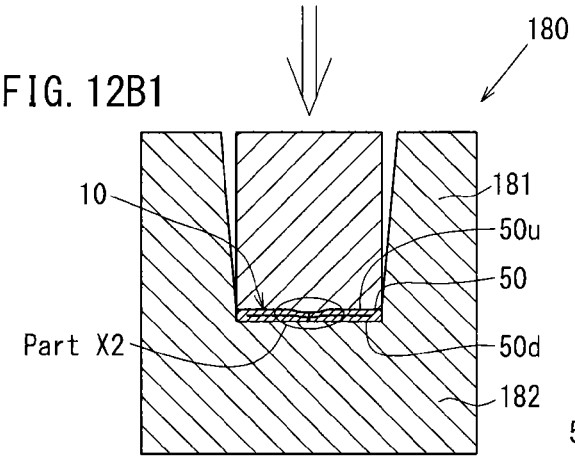
FIG. 12B2
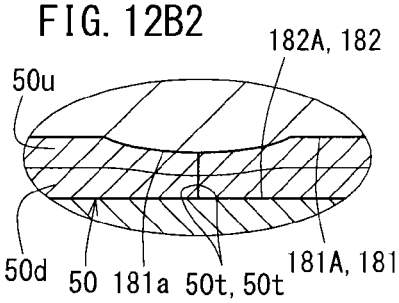

FIG. 17A1
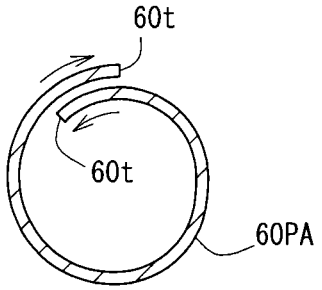
FIG. 17A2
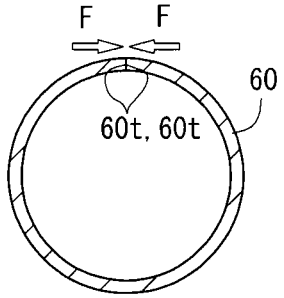
FIG. 17B1
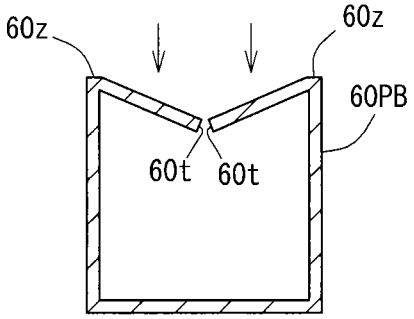
FIG. 17B2
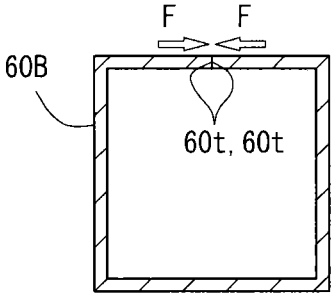

CYLINDRICAL BODY, CRIMP TERMINAL, AND MANUFACTURING METHOD THEREOF, AS WELL AS MANUFACTURING APPARATUS OF CRIMP TERMINAL

TECHNICAL FIELD

The present invention relates to a crimp terminal, and a manufacturing method of the crimp terminal as well as a manufacturing apparatus of the crimp terminal, by bend processing, from an unprocessed shape into a cylindrical crimping section, a crimping portion corresponding part of a sheet-shaped terminal base material as a portion corresponding to a crimping section that crimps by swaging a conductor tip having an insulating cover peeled off at least at a tip side of an insulated wire covering a conductor with the insulating cover, in a terminal bend processing process of bend processing the sheet-shaped terminal base material into a terminal shape.

BACKGROUND ART

A crimp terminal is manufactured by processing a terminal connection band into a terminal shape by performing a suitable bending process to a terminal member which is stretched from at least one end side in a width direction of a carrier while intermittently feeding the terminal connection band along a carrier longitudinal direction, and by disconnecting the terminal member from the carrier. The terminal connection band including a carrier formed in a band shape is formed by punching a sheet-shaped terminal base material. "A molding device and a processing method that uses the molding device" disclosed in Patent Document 1 is one of this technique, for example.

The crimp terminal includes an open barrel type and a closed barrel type according to a model of a crimping section that is crimped to the insulated wire.

A crimping section of the open barrel type crimp terminal is formed in approximately a U shape in a longitudinal cross section of which an upper portion is opened, like the barrel disclosed in Patent Document 1. In connecting a tip of the insulated wire, a conductor tip of the insulated wire having the conductor exposed is arranged on the crimping section, and thereafter, the crimping section is crimped to at least the conductor tip at the tip side of the insulated wire.

The crimping section of the closed barrel type crimp terminal is formed in a cylindrical shape so that after the conductor tip is inserted into the crimping section, the crimping section can be crimped by being plastically deformed in a radially reducing direction.

The closed barrel type crimp terminal like this can have a crimped conductor tip surrounded by a whole external periphery in the state of being inserted into the cylindrical crimping section. Therefore, the closed barrel type crimp terminal has an excellent characteristic of being able to securely protect the conductor tip from an external factor such as water because the crimping section is in a cylindrical shape.

In order to keep high reliability of the cylindrical crimping section having such an excellent characteristic, it has been necessary to cylindrically process the crimping section securely and easily.

PRIOR ART DOCUMENT

Patent Document

Patent Document 1: Japanese Laid-Open Patent Publication No. 2003-25026

SUMMARY OF THE INVENTION

Problems to be Solved by the Invention

An object of the present invention is to provide a cylindrical body, a crimp terminal that includes a crimping section, and a manufacturing method of the cylindrical body and the crimp terminal as well as a manufacturing apparatus of the crimp terminal, the cylindrical body capable of making opposed end parts oppose each other in the state that opposed portions where the opposed end parts oppose each other at a bend processing portion that is cylindrically bend processed can be securely welded.

Solutions to the Problems

The present invention provides a manufacturing method of a cylindrical body for processing at least a part of a bend processing portion of a sheet member from an unprocessed shape into a cylindrical shape. The manufacturing method includes performing in order a high bending-rate processing process of bend processing at least a part of the bend processing portion in a width direction at a bending rate higher than a bending rate for plastically deforming the part from the unprocessed shape into the predetermined bend processing shape, and a shaping process of shaping the bend processing portion processed in the high bending-rate processing process into a cylindrical shape.

According to the above configuration, it is possible to provide a cylindrical body that includes a bend processing portion that can be securely kept in a cylindrical shape without unexpectedly generating a gap between the end parts at a butted portion where the opposed end parts are butted.

This will be described in more detail. When the bend processing portion is simply bent in a cylindrical shape, compressive force (reactive force of tensile force) works as internal stress on an external portion in a thickness direction of the bend processing portion. At the same time, tensile force (reactive force of compressive force) works on an internal portion, and stress like this remains at the bend processing portion even after the bend processing.

As a result, the internal stress to restore a pre-bend processing shape works on the bend processing portion, a gap occurs unexpectedly between the end parts at the butted portion where the opposed end parts at the bend processing portion are butted, and it has been impossible to keep a cylindrical shape after the bend processing.

On the other hand, by performing the high bending-rate processing process, at the external portion in the thickness direction of the bend processing portion, it is possible to obtain the state that the internal stress does not work, or apply tensile force of pulling outward in a peripheral direction, that is, reactive force against compressive force.

Further, at the internal portion in the thickness direction of the bend processing portion, it is possible to obtain the state that the internal stress does not work, or apply compressive force of compressing inward in a peripheral direction, that is, reactive force against tensile force.

Therefore, a gap does not unexpectedly occur between the end parts at a butted portion where the opposed end parts are butted, and the bend processing portion after the bend processing can be securely kept in a cylindrical shape.

The cylindrical body is not particularly limited so far as the cylindrical body is a member that needs to be kept in a cylindrical shape by bend processing at least a part of a bend processing portion of the sheet member from an unprocessed shape into a cylindrical shape. For example, a crimp terminal described later is suitable.

The present invention provides a manufacturing method of a crimp terminal, the crimp terminal including a cylindrical crimping section which crimps a conductor tip having an insulating cover peeled off at least at a tip side of an insulated wire which covers a conductor with the insulating cover. The manufacturing method includes performing a high bending-rate processing process and a shaping process in this order. The high bending-rate processing process includes forming the cylindrical body by the crimp terminal, includes forming the sheet member by a sheet-shaped terminal base material including a crimping portion corresponding part which corresponds to the crimping section before a bend processing, includes forming the bend processing portion by the crimping portion corresponding part, and includes bend processing at least a part of a deformation portion to be plastically deformed into a predetermined bend processing shape in the crimping portion corresponding part, at a bending rate higher than a bending rate of plastically deforming the part from an unprocessed shape into the predetermined bend processing shape, along with the bend processing of at least the crimping portion corresponding part of the terminal base material from the unprocessed shape into the cylindrical shape. The shaping process includes shaping the crimping portion corresponding part processed in the high bending-rate processing process into the crimping section of a cylindrical shape.

According to the above configuration, the crimping portion corresponding part is not directly bend processed in the cylindrical shape from the unprocessed shape, but in the high bending-rate processing process, at least a part of the deformation portion in the crimping portion corresponding part is bend processed at the bending rate higher than the bending rate of plastically deforming the part from the unprocessed shape into the predetermined bend processing shape.

In this state, by performing the shaping process to obtain the crimping section of a cylindrical shape to be finally processed by the terminal bend processing process, it becomes possible to generate inward force that causes the opposed end parts to be closely contacted to each other at the opposed portions of the crimping section, depending on a bending rate of bend processing the crimping portion corresponding part, and the opposed end parts can be butted against each other to press each other.

That is, the outward force of the crimping section to separate the opposed end parts to restore the unprocessed shape from the predetermined processing shape can be canceled.

Therefore, because the opposed portions where the opposed end parts are opposed in the cylindrically bend-processed crimping section do not generate a gap, or because the opposed end parts can be kept in a gap where the opposed ends can be welded, the opposed portions can be securely welded.

Regarding the high bending-rate processing process that is performed to at least a part of the deformation portion, it is preferable to perform the processing at a certain level of bending rate at which there remains internal stress in a direction in which there occurs inward force for positively bringing the opposed tips that are opposed in the peripheral direction of the crimping section to be in close contact with each other. However, without limiting to this processing, the high bending-rate processing process also includes simply a processing at a certain level of bending rate at which outward force of separating the opposed end parts from each other is suppressed.

That is, when at least the internal stress in the direction of separating the opposed end parts that are opposed in the peripheral direction is not working, the high bending-rate processing process also includes a case where the internal stress of positively bringing the opposed end parts opposed in the peripheral direction to be brought into close contact with each other is not working, so far as a certain level of force that suppresses the internal stress in a direction of separating the opposed end parts from each other works.

The bending rate of the bend processing in the high bending-rate processing process is not particularly limited so far as the bending rate is higher than the bending rate for plastically deforming from the unprocessed shape into the predetermined bend processing shape. For example, the bending rate of the bend processing in the high bending-rate processing process can be determined according to a material of a sheet-shaped terminal material, a sheet thickness, and bending force and a bending radius at the time of performing a bend processing.

The predetermined bend processing shape indicates a final shape of the deformation portion obtained by plastically deforming the crimping portion corresponding part in the terminal bend processing process.

The unprocessed shape indicates a shape of the crimping portion corresponding part before bend processing the crimping portion corresponding part into a cylindrical shape, and indicates a flat shape, for example.

A shape of the crimping section is not particularly limited so far as the orthogonal cross section that is orthogonal with the longitudinal direction is cylindrical, such as a circular shape, an oblong shape, and a polygonal shape.

The deformation portion in the crimping portion corresponding part may be a whole of the crimping portion corresponding part in the orthogonal direction orthogonal with a terminal axis direction, or may be a plurality of portions, and is not particularly limited so far as the deformation portion is at least a part of the crimping portion corresponding part.

Similarly, a portion to which the high bending-rate processing process is performed at the deformation portion may be a whole of an orthogonal direction orthogonal with a terminal axis direction of the deformation portion, or may be a plurality of portions, and is not particularly limited so far as the portion to which the high bending-rate processing process is performed is at least a part of the deformation portion.

The conductor can be twisted wires of raw wires or can be a single wire, and can be configured by a dissimilar metal that is a less noble metal relative to a metal that configures the crimp terminal, by forming the conductor using an aluminum conductor made of aluminum or an aluminum alloy, for example. Without limiting to the above metal, the conductor may be also configured by a metal of the same type as that of the crimp terminal, by forming the conductor by a copper conductor made of copper or a copper alloy, for example.

As a mode of the present invention, by setting the deformation portion in a whole of an orthogonal direction orthogonal with a terminal axis direction of the crimping portion corresponding part, in the shaping process, the crimping portion corresponding part processed in the high bending-rate processing process can be processed by shaping the crimping portion corresponding part so that the orthogonal cross section orthogonal with the terminal axis direction becomes a circular shape.

According to the above configuration, it is possible to manufacture a crimp terminal that includes a cylindrical crimping section which cancels the internal stress in the direction of separating the opposed end parts from each other in the peripheral direction.

In the shaping process, a method of processing the crimping portion corresponding part by shaping the orthogonal cross section so that the orthogonal cross section becomes a circular shape is not particularly limited, and the crimping portion corresponding part can be shaped by winding the crimping portion corresponding part around a columnar core bar, for example.

In the shaping process, the crimping portion corresponding part may be shaped into a cylindrical crimping section at a plurality of times by using a plurality of jigs corresponding to bending rates, without limiting to shaping at one time by using a jig of one kind of bending rate.

Further, as a mode of the present invention, by setting at least a part of the deformation portion in an intermediate portion in an orthogonal direction orthogonal with a terminal axis direction of the crimping portion corresponding part, in the high bending-rate processing process, the intermediate portion can be bend processed at a bending rate higher than the bending rate for plastically deforming the intermediate portion from the unprocessed shape into the predetermined bend processing shape.

According to the above configuration, by setting at least a part of the deformation portion in an intermediate portion in the orthogonal direction of the crimping portion corresponding part, one side and the other side relative to the intermediate portion that becomes the portion processed at the high bending-rate can be set in the same lengths.

Accordingly, in the shaping process, in shaping the crimping portion corresponding part into a cylindrical shape, one side portion and the other side portion can be shaped into arc shapes in good balance, as compared with a case where one side and the other side are in different lengths relative to the portion processed at the high bending-rate, for example. Therefore, when the crimping portion corresponding part is cylindrically shaped, inward force of approximately the same magnitude can be generated in each of the pair of opposed end parts at the opposed portions of the crimping section, and mutually pressing force of the pair of opposed end parts can be set to work in good balance.

Further, as a mode of the present invention, the terminal base material includes a transition corresponding part provided continuously to the crimping portion corresponding part at a tip side in a terminal axis direction. Prior to the high bending-rate processing process, an end-part raising process is performed to raise an end part of the crimping portion corresponding part in the width direction and raising the transition corresponding part in the same direction as a raising direction of the crimping portion corresponding part, a bottom raising process is performed to raise the bottom of the transition corresponding part simultaneously with the end-part raising of the crimping portion corresponding part and the transition corresponding part, and after the bottom raising process, a sealing portion corresponding part provided in the portion continuous with the crimping section in the transition corresponding part is cylindrically bend processed together with the cylindrical bend processing of the crimping portion corresponding part.

Further, as a mode of the present invention, in at least one process out of the high bending-rate processing process and the shaping process, there can be performed a process of inserting a core bar into the crimping portion corresponding part after bringing the end parts of the crimping portion corresponding part in the width direction into close contact with each other in the peripheral direction, and a process of pressurizing the crimping portion corresponding part in the core-bar inserted state by a pressurizing mold.

Further, as a mode of the present invention, a cross section of the core bar is in a circular shape, and in the shaping process, a cylindrical crimping section can be formed by a process of pressurizing from outside, by a pressurizing mold, the crimping portion corresponding part into which the core bar is inserted.

Further, as a mode of the present invention, the sealing portion corresponding part can be formed as a flat-shaped sealing portion by flattening the sealing portion corresponding part in the thickness direction.

Further, as a mode of the present invention, after the shaping process, a welding process of welding both ends of the crimping section in the peripheral direction along the terminal axis direction by a high-energy density heat source can be performed.

According to the manufacturing method of a crimp terminal, in the welding process, the opposed end parts of the crimping section in the peripheral direction can be smoothly and securely fixed to each other by welding along the terminal axis direction by the high-energy density heat source.

The conductor tip that is inserted into the crimping section can be crimped by the conductor tip and the crimping section in the state that the conductor tip is surrounded by the crimping section, and excellent water-blocking performance can be obtained.

Welding by the high-energy density heat source indicates to weld by laser, electronic beam, or plasma.

Particularly, among lasers, fiber laser welding can match the focus on an extremely small spot, as compared with other laser welding, and can realize high-output laser welding, and is preferable because continuous welding is possible.

The present invention provides a manufacturing apparatus that manufactures a crimp terminal including a cylindrical crimping section that crimps a conductor tip having an insulating cover peeled off at least at a tip side of an insulated wire which covers a conductor with the insulating cover. The manufacturing apparatus includes a high bending-rate processing jig and a shaping jig. The high bending-rate processing jig performs a bend processing of at least a part of a deformation portion of a crimping portion corresponding part to be plastically deformed into a predetermined bend processing shape at a bending rate higher than a bending rate of plastically deforming the part from an unprocessed shape into the predetermined bend processing shape, along with the bend processing of the crimping portion corresponding part corresponding to a crimping section of a sheet-shaped terminal base material, from an unprocessed shape into the cylindrical shape. The shaping jig shapes the crimping portion corresponding part that is bend processed by the high bending-rate processing jig, into the crimping section of a cylindrical shape.

Both the high bending-rate processing jig and the shaping jig may be configured to include not only a jig that press processes the crimping portion corresponding part but also a jig such as a core bar that bend processes by winding the crimping portion corresponding part.

As a mode of the present invention, by setting the deformation portion in a whole in an orthogonal direction orthogonal with a terminal axis direction of the crimping portion corresponding part, by the shaping jig, the crimping portion corresponding part processed by the high bending-rate processing jig can be processed by shaping the crimping portion corresponding part so that the orthogonal cross section orthogonal with the terminal axis direction becomes a circular shape.

The crimping section can be shaped by winding the crimping portion corresponding part around a columnar core bar, for example.

In the shaping process, the process of shaping into the cylindrical crimping section may be performed at stages at a plurality of times by using a plurality of jigs corresponding to bending rates, without limiting to shaping at one time by using a jig of one kind of bending rate.

Further, as a mode of the present invention, by setting at least a part of the deformation portion in an intermediate portion in the orthogonal direction of the crimping portion corresponding part, the intermediate portion can be bend processed by the high bending-rate processing jig so that a bending rate becomes higher than a bending rate for plastically deforming the intermediate portion from the unprocessed shape into the predetermined bend processing shape.

Further, as a mode of the present invention, both ends of the crimping section in the peripheral direction that is cylindrically bend processed by the terminal bend processing unit can be welded along the terminal axis direction by a high-energy density heat source generation welding unit.

The present invention provides a cylindrical body obtained by bend processing at least a part of a bend processing portion of a sheet member into a cylindrical shape. At an external portion of the bend processing portion in a thickness direction, internal stress of pulling outward in a peripheral direction works, and at an internal portion in the thickness direction, internal stress of compressing inward in the peripheral direction works.

According to the above configuration, at the external portion in the thickness direction of the bend processing portion, it is possible to obtain the state that the internal stress does not work, or it is possible to obtain tensile force of pulling to outside in a peripheral direction, that is reactive force against compressive force.

Further, at the internal portion in the thickness direction of the bend processing portion, it is possible to obtain the state that the internal stress does not work, or it is possible to obtain compressive force of compressing to inside in a peripheral direction, that is reactive force against tensile force.

Therefore, a gap does not unexpectedly occur between the end parts at a butted portion where the opposed end parts are butted. The bend processing portion after the bend processing can be securely kept in a cylindrical shape.

In the present invention, a connection part to be connected to a connection other-side member, a transition section for joining the connection part and a crimping section, and the crimping section are arranged in this order, from a tip side to a base side in a terminal axis direction, and the transition section is formed by raising a bottom to the connection part and the crimping section.

Further, as a mode of the present invention, a welding part that is fixed along a terminal axis direction by welding, by a high-energy density heat source, both ends in a peripheral direction of the crimping section that is cylindrically bend processed by the terminal bend processing unit can be formed at the both ends.

The present invention provides a sheet-shaped terminal metal fitting in a pre-bend processing state, including a cylindrical crimping section which crimps a conductor tip having an insulating cover peeled off at least at a tip side of an insulated wire which covers a conductor with the insulating cover, and a sealing portion for sealing an opening part of the crimping section at a tip side in a terminal axis direction. The crimping section includes a conductor crimping section that crimps the conductor tip, a cover crimping section that crimps the conductor tip, and a step that is present between the conductor crimping section and the cover crimping section. A crimping portion corresponding part which corresponds to the crimping section before a bend processing is formed in a width corresponding to an external peripheral shape of each of the conductor crimping section, the step, and the cover crimping section, along a base end side to a tip side in the terminal axis direction, and is also formed so that an external end part in the width direction becomes an inclined shape to the terminal axis direction so as to be gradually in a small width. A sealing portion corresponding part which corresponds to the sealing portion before the bend processing is formed in a width corresponding to an external peripheral shape of the sealing portion, and is also formed so that an external end part in the width direction becomes approximately parallel to the terminal axis direction.

According to the above configuration, in the bend processing process, by considering the occurrence of unexpected extension in the material that forms the crimping portion corresponding part due to the crimping portion corresponding part receiving a load at the time of bend processing an extended-shape terminal metal fitting into a three-dimensional shape by pressing by a bend processing mold, the crimping portion corresponding part is formed so that the external end part in the width direction becomes an inclined shape to the terminal axis direction so as to be gradually in a small width toward the tip side in the terminal axis direction.

Accordingly, even when the bend processing is performed to the crimping portion corresponding part that can easily receive the influence of the extension of the material, the opposed portions where the opposed end parts are butted in the peripheral direction can be cylindrically bend processed without generating a gap.

On the other hand, in the bend processing process, regarding the sealing portion corresponding part where extension of the material does not easily occur when bend processing an developed-shape terminal metal fitting into a three-dimensional shape by pressing by a bend processing mold, the sealing portion corresponding part is formed so that the external end part in the width direction becomes approximately parallel to the terminal axis direction. Therefore, even when the bend processing is performed to the sealing portion corresponding part, the opposed portions where the opposed end parts are butted in the peripheral direction can be cylindrically bend processed without generating a gap.

Therefore, because both end parts of the crimping section and the sealing portion can be butted against each other without a gap, the both end parts can be securely fixed by welding along the terminal axis direction by a high-energy density heat source.

Further, the present invention provides a wire harness including a plurality of crimping connection structural bodies that have the crimping section in the crimp terminal crimp connected by swaging, to a conductor tip which has a conductor exposed by peeling off an insulating cover at least at a tip side of an insulated wire covering the conductor with the insulating cover, and also includes a connector housing which can house the crimp terminal in the connection structural body. The crimp terminal is arranged in the connector housing.

According to the present invention, the opposed portions where the opposed end parts are opposed in the cylindrically bend-processed crimping section can be set to oppose each other in a securely butted state. Therefore, the conductor tip arranged inside the crimping section can be crimped in a securely surrounded state.

Therefore, a connection portion between the insulated wire and the crimp terminal can be set in the state of excellent water-blocking performance.

Accordingly, the wire harness in the present invention can be configured to include a plurality of crimping connection structural bodies excellent in the water-blocking performance.

The crimping connection structural body indicates, for example, a wire having a terminal that has the crimping section crimped to the conductor tip, in the state that at least the conductor tip at the tip side of the insulated wire is inserted into the crimping section.

Effects of the Invention

According to the present invention, it is possible to provide a cylindrical body, a crimp terminal that includes a crimping section, and a manufacturing method of the cylindrical body and the crimp terminal as well as a manufacturing apparatus of the crimp terminal, the cylindrical body capable of making opposed end parts oppose each other in the state that opposed portions where the opposed end parts oppose each other at a bend processing portion that is cylindrically bend processed can be securely welded.

BRIEF DESCRIPTION OF THE DRAWINGS

FIGS. 3A to 3C3 are configuration explanatory views of portions of a terminal connection band in a carrier longitudinal direction.

FIGS. 4A to 4C3 are configuration explanatory views of portions of a terminal connection band in a carrier longitudinal direction.

FIGS. 5A to 5C3 are configuration explanatory views of portions of a terminal connection band in a carrier longitudinal direction.

FIGS. 11A1 to 11B2 are explanatory views of a seventh terminal processing unit.

FIGS. 12A1 to 12B2 are explanatory views of an eighth terminal processing unit.

FIGS. 17A1 to 17B2 are explanatory views of a bend processing of a crimping section in other embodiments.

EMBODIMENTS OF THE INVENTION

An embodiment of the present invention will be described below with reference to the drawings.

Figure 1A:
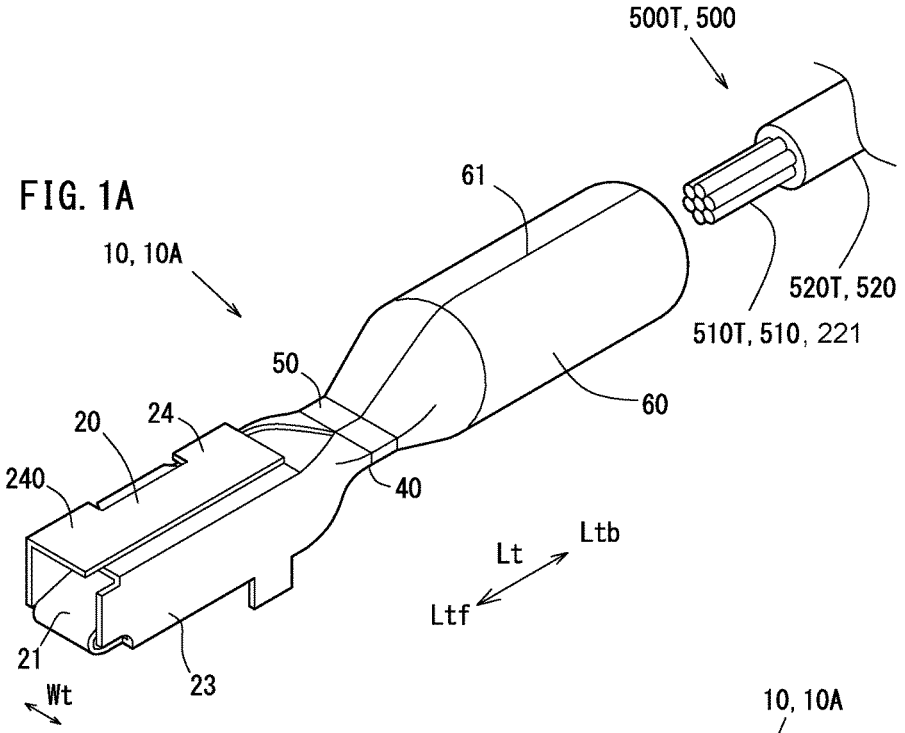
FIGS. 1A and 1B are configuration explanatory views of a crimp terminal.
Figure 1B:
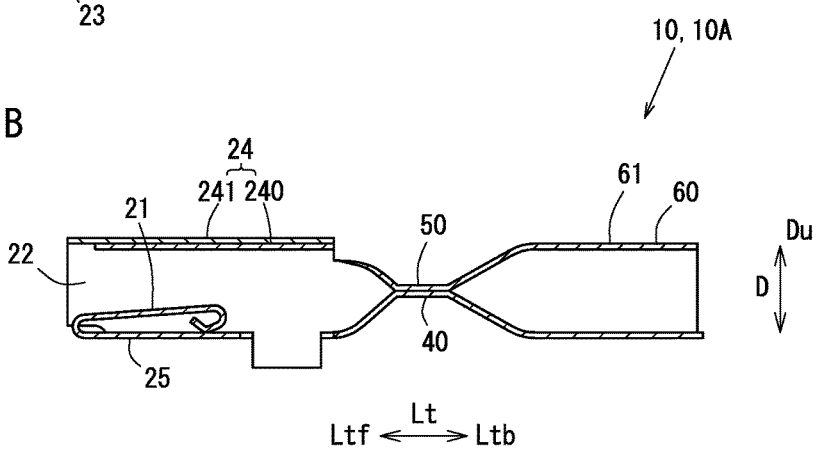
Figure 2:
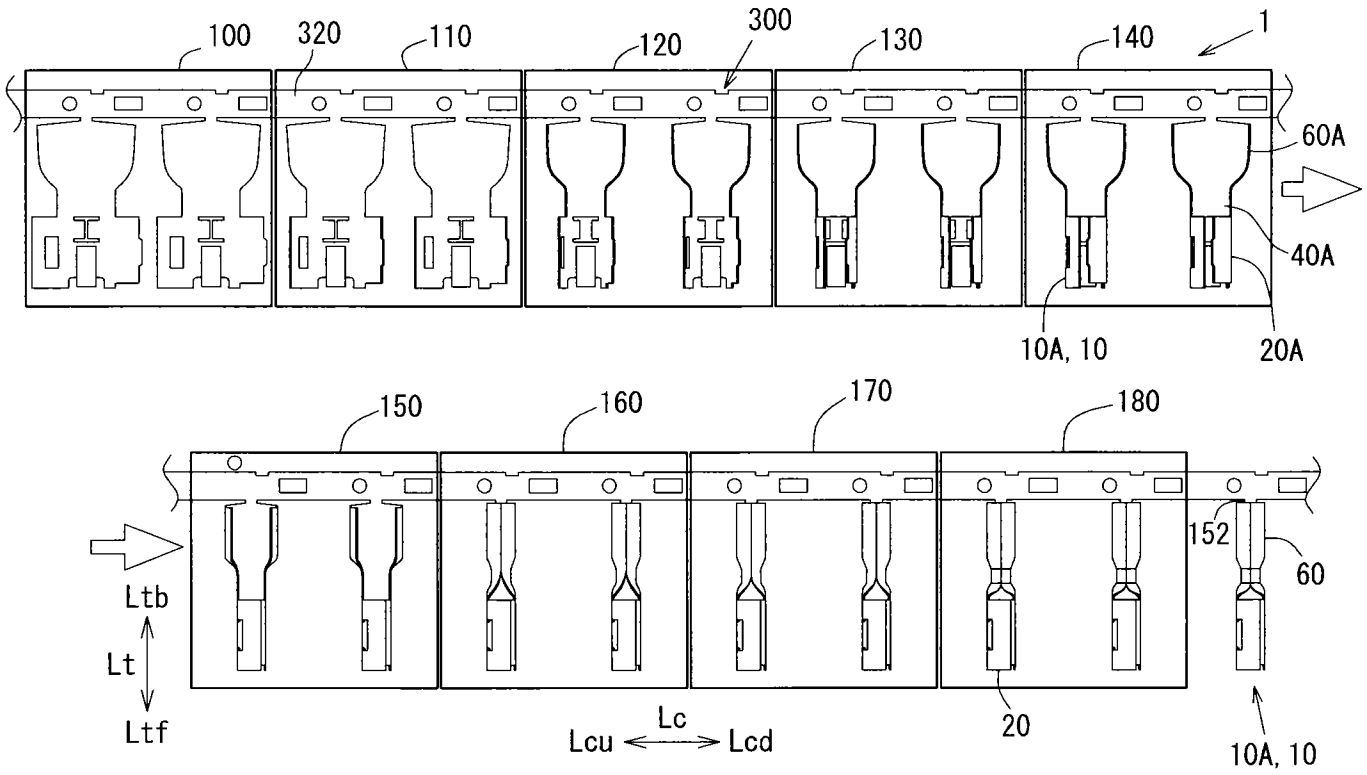
FIG. 2 is a configuration explanatory view of a terminal manufacturing apparatus according to the present embodiment.
Figure 3A:
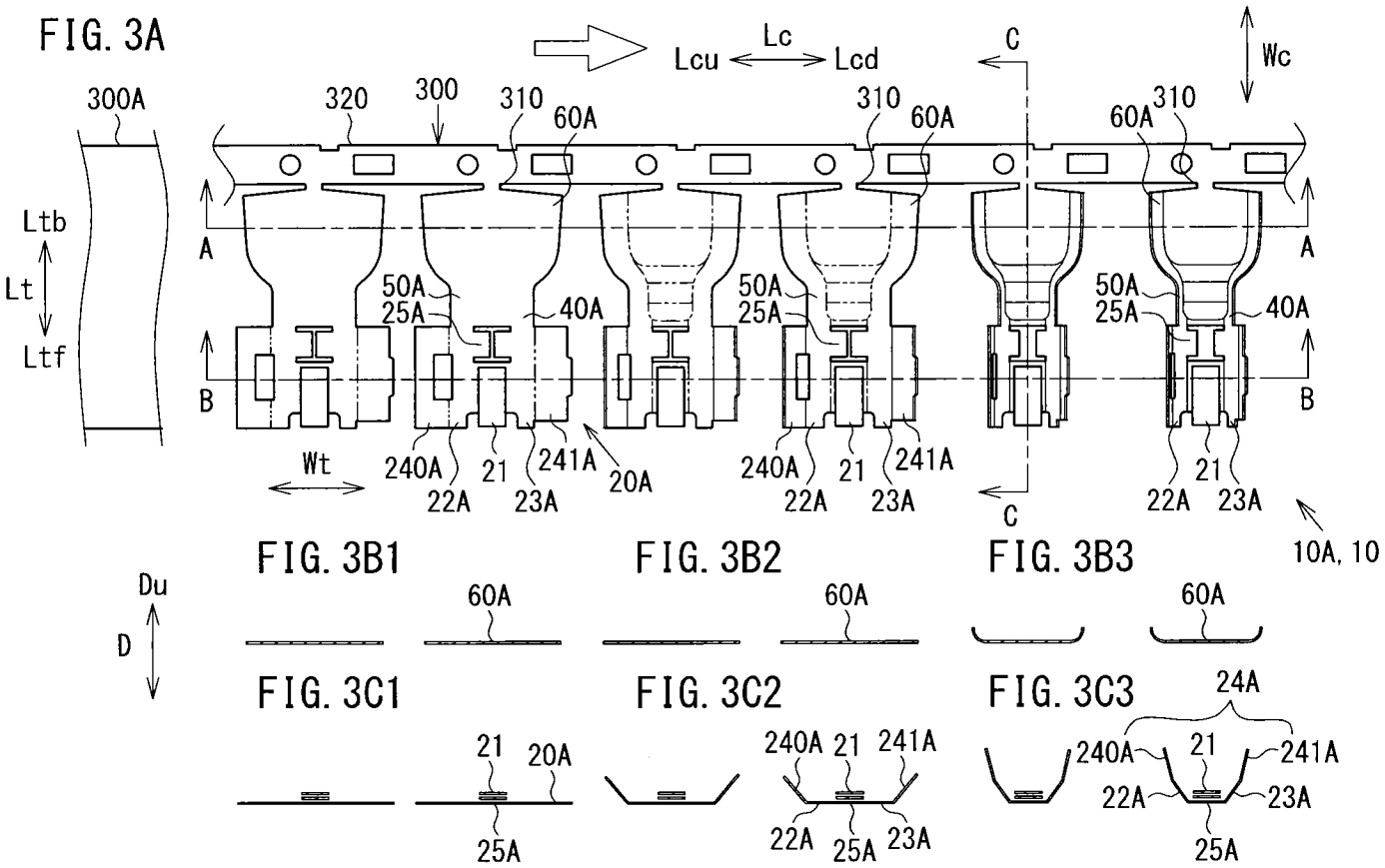
Figure 4A:
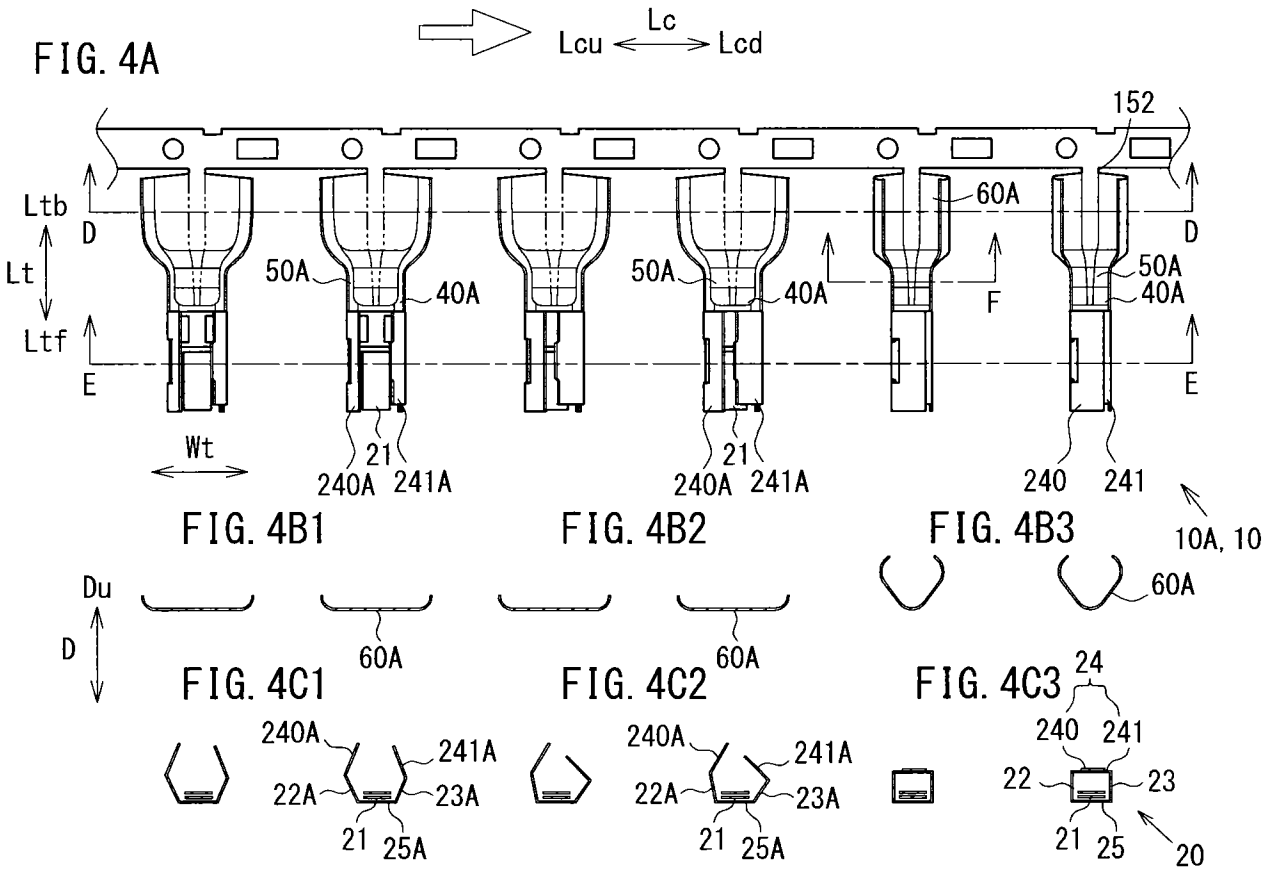
Figure 5A:
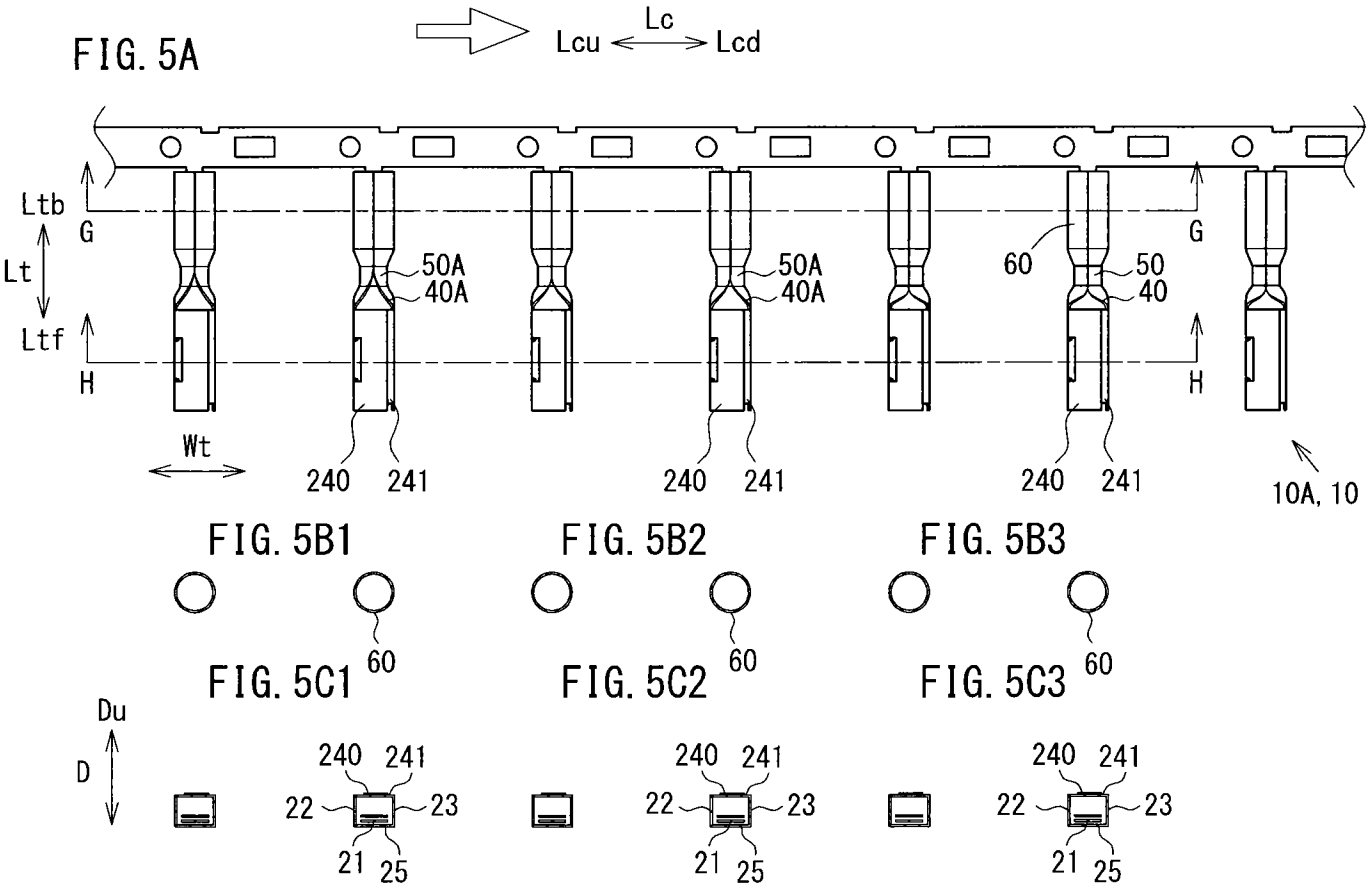

FIG. 1A is an external view of a crimp terminal 10, and a wire tip 500T, and FIG. 1B is a vertical sectional view of an intermediate portion of the crimp terminal 10 in a width direction. FIG. 2 is a conceptual diagram schematically showing a layout of a main configuration of a manufacturing apparatus 1 of the crimp terminal 10. FIG. 3A is a plan view of an upstream side portion of a terminal connection band 300 in a carrier longitudinal direction Lc. FIGS. 3B1, 3B2, and 3B3 show sectional views of portions corresponding to a terminal pre-processing unit 100, a first terminal processing unit 110, and a second terminal processing unit 120 in a line A-A cross section in FIG. 3A. FIGS. 3C1, 3C2, and 3C3 show sectional views of portions corresponding to the terminal pre-processing unit 100, the first terminal processing unit 110, and the second terminal processing unit 120 in a line B-B cross section in FIG. 3A. FIG. 4A is a plan view of a center portion of the terminal connection band 300 in the carrier longitudinal direction Lc. FIGS. 4B1, 4B2, and 4B3 show sectional views of portions corresponding to a third terminal processing unit 130, a fourth terminal processing unit 140, and a fifth terminal processing unit 150 in a line D-D cross section in FIG. 4A. FIGS. 4C1, 4C2, and 4C3 show sectional views of portions corresponding to the third terminal processing unit 130, the fourth terminal processing unit 140, and the fifth terminal processing unit 150 in a line E-E cross section in FIG. 4A. FIG. 5A is a plan view of a center portion of the terminal connection band 300 in the carrier longitudinal direction Lc. FIGS. 5B1, 5B2, and 5B3 show sectional views of portions corresponding to a sixth terminal processing unit 160, a seventh terminal processing unit 170, and an eighth terminal processing unit 180 in a line G-G cross section in FIG. 5A. FIGS. 5C1, 5C2, and 5C3 show sectional views of portions corresponding to the sixth terminal processing unit 160, the seventh terminal processing unit 170, and the eighth terminal processing unit 180 in a line H-H cross section in FIG. 5A.

The manufacturing apparatus 1 of the crimp terminal 10 according to the present embodiment punches a flat-sheet shape terminal base material 300A (sheet shape), as a flat-sheet shape terminal connection band 300 including a carrier 300 and a terminal metal fitting 10A that is stretched from at least one end side of the carrier 300 in a width direction, as shown in FIG. 2 and FIG. 3A, while intermittently feeding the terminal material 300A from an upstream side Lcu, by a mechanism not shown. At the same time, the manufacturing apparatus 1 intermittently performs a suitable process such as a bend processing of a plurality of terminal metal fittings 10A that are provided in a chain shape along a longitudinal direction of the carrier 320 and disconnects the terminal metal fittings 10A processed into a terminal shape from the carrier 320. As result, the crimp terminal 10 is manufactured.

In the following description, a longitudinal direction of the carrier 320 is set as the carrier longitudinal direction Lc. A width direction of the carrier 320 is set as a carrier width direction Wc. A feeding direction (a downstream side) of the carrier 320 in the carrier longitudinal direction Lc is set as a carrier longitudinal direction downstream side Lcd. A direction (an upstream side) opposite to the direction of feeding the carrier 320 is set as a carrier longitudinal direction upstream side Lcu.

Further, a longitudinal direction of the crimp terminal 10 (the terminal metal fitting 10A) is set as a terminal axis direction Lt, and a width direction of the crimp terminal 10 is set as a terminal width direction Wt. The terminal width direction Wt is a direction that matches the carrier longitudinal direction Lc. A box portion 20 side of a crimping section 60 in the terminal axis direction Lt is set as a front Ltf (a tip side), and oppositely, a crimping section 60 side of the box portion 20 is set as a back Ltb (a base end side).

Further, in a thickness direction D of the crimp terminal 10 (the terminal metal fitting 10A), one side in a thickness direction of bend processing around the terminal axis is set as an upper direction (Du).

First, a configuration of the crimp terminal 10 that is manufactured by a manufacturing method of the crimp terminal 10 will be described with reference to FIGS. 1A and 1B to FIG. 5.

The crimp terminal 10 is in a closed barrel type, and is formed in a female crimp terminal shape. The terminal metal fitting 10A that is stretched from one end side of the terminal connection band 300 in the carrier width direction We to outside in the carrier width direction We via a connection part 310 shown in FIG. 2 to FIG. 5 is formed by being disconnected from the carrier 320.

The crimp terminal 10 is integrally configured by the box portion 20 that permits the insertion of an insertion tab of the female crimp terminal 10 not shown, a sealing portion 50 which is formed in a transition section 40 of a predetermined length at the back of the box portion 20, and a crimping section 60 which is arranged continuously with the sealing portion 50 in the terminal axis direction via the transition section 40, from the front Ltf as the tip side of the terminal axis direction Lt toward the back Ltb.

The box portion 20 is configured by an inverse hollow square pole, and includes in the inside an elastic contact piece 21 which is in contact with an insertion tab (not shown) of a male connector which is to be inserted by being returned backward in the terminal axis direction Lt.

The box portion 20 as the hollow square pole is configured in a cuboid shape which is slender in the terminal axis direction Lt, by having a right side surface part 22, a left side surface part 23, an upper surface part 24, and a bottom surface part 25 confronted to each other.

The box portion 20 has the right side surface part 22 and a one side upper surface part 240 continuously provided to the bottom surface part 25 toward the outside at one side of the terminal width direction Wt, and has the left side surface part 23 and the other side upper surface part 241 continuously provided toward the outside at the side of the terminal width direction Wt, in a developed shape, as shown in FIG. 3A.

The one side upper surface part 240 and the other side upper surface part 241 are overlapped with each other, and configure the upper surface part 24, when the surface parts that configure the box portion 20 are folded in a peripheral direction to be configured in the cuboid shape.

The sealing portion 50 is configured in a flat shape, by deforming the portions of the transition section 40 at the crimping section 60 to be crushed in approximately a flat-sheet shape mutually overlapping predetermined portions that are opposite in a vertical direction.

The crimping section 60 is formed in a cylindrical shape capable of inserting the wire tip 500T at least at a tip side of an insulated wire 500, and is also integrally formed in a continuous shape continuous in a whole peripheral direction. A length of the crimping section 60 is not particularly limited so far as the crimping section 60 includes a length in which a conductor tip 510T described later of the insulated wire 500 can be inserted.

The insulated wire 500 is configured by covering a conductor 510 with an insulating cover 520 configured by an insulating resin. The conductor 510 is formed by superposing a plurality of aluminum raw wires 221 formed by aluminum or an aluminum alloy, as shown in FIG. 1A.

The wire tip 500T is configured by the conductor tip 510T obtained by exposing the conductor 510 by peeling off the tip-side insulating cover 520, at the tip side of the insulated wire 500, and a conductor tip 520T at the tip side of the insulating cover portion at the back of the conductor tip 510T at the tip side of the insulated wire 500, as shown in FIG. 1A.

In the crimping section 60, a welding part 61 where opposed end parts 60*t* are welded together is formed along the terminal axis direction Lt, at opposed portions where the opposed end parts 60*t* are opposed to each other in the peripheral direction.

The crimping section 60 can be electrically connected to the wire tip 500T, by crimping by swaging in the state that the wire tip 500T is inserted.

Next, the manufacturing apparatus 1 and a manufacturing method for manufacturing the crimp terminal 10 will be described with reference to FIG. 2 to FIG. 15.

Figure 6:
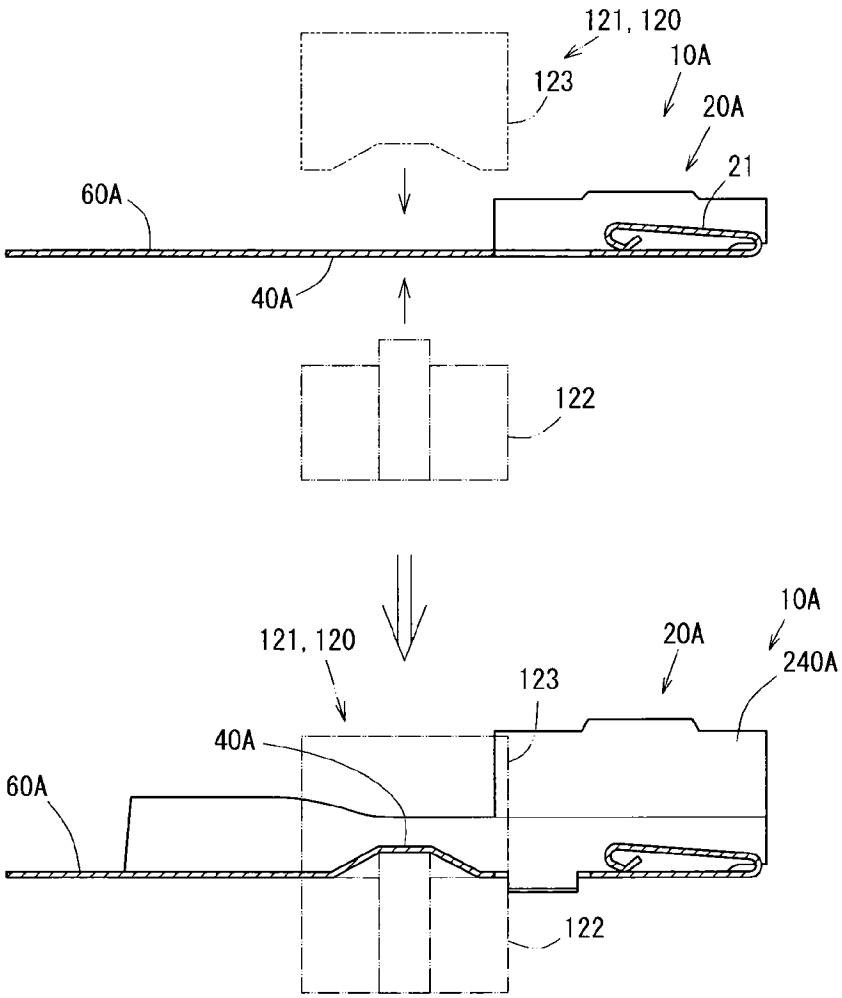
FIG. 6 is an explanatory view of a second terminal processing process.
Figure 7:
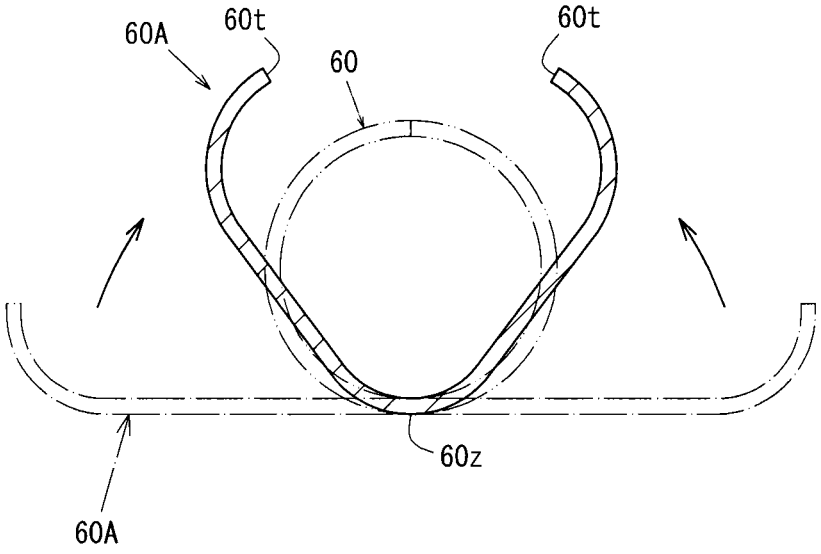
FIG. 7 is an explanatory view of a fifth terminal processing process.

FIG. 6 is an explanatory view of a second terminal processing process. FIG. 7 is an orthogonal sectional view of a crimping portion corresponding part 60A showing a state of a change in the shape of the crimping portion corresponding part 60A in the terminal axis direction Lt when the high bending-rate processing process is performed.

Figure 8A:
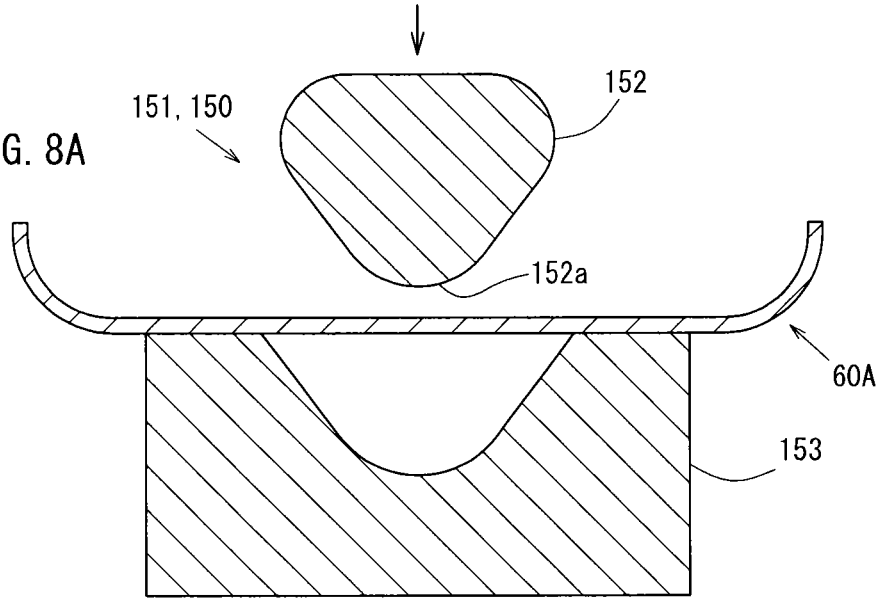
FIGS. 8A and 8B are explanatory views of the fifth terminal processing process.
Figure 8B:
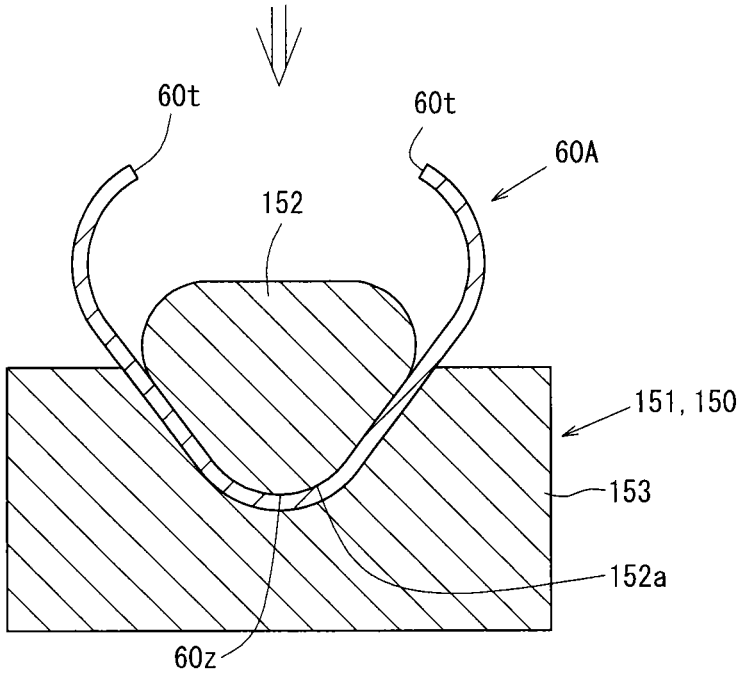
Figure 9:
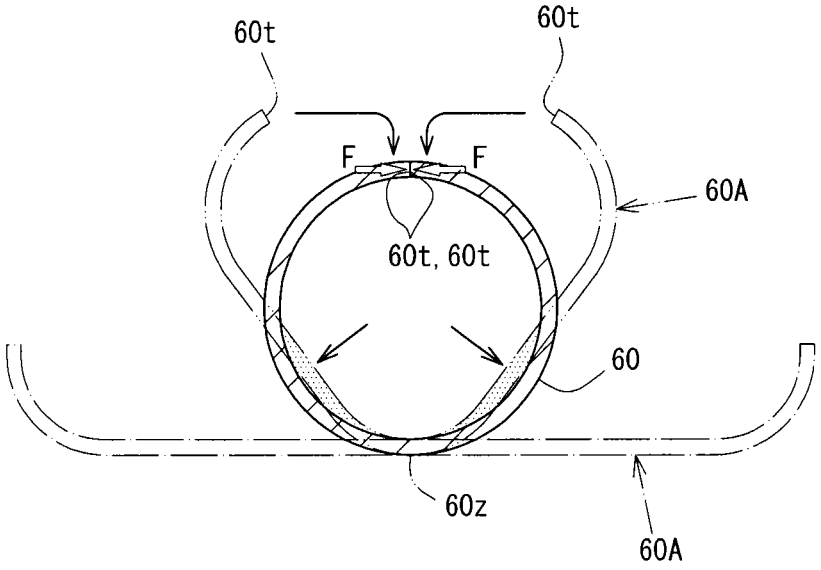
FIG. 9 is an explanatory view of a sixth terminal processing process.
Figure 10A:
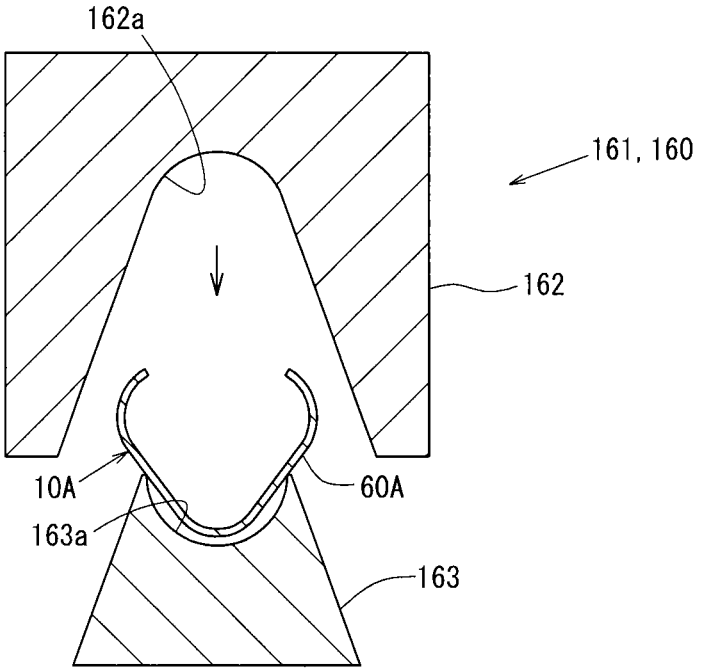
FIGS. 10A and 10B are explanatory views of the sixth terminal processing process.
Figure 10B:
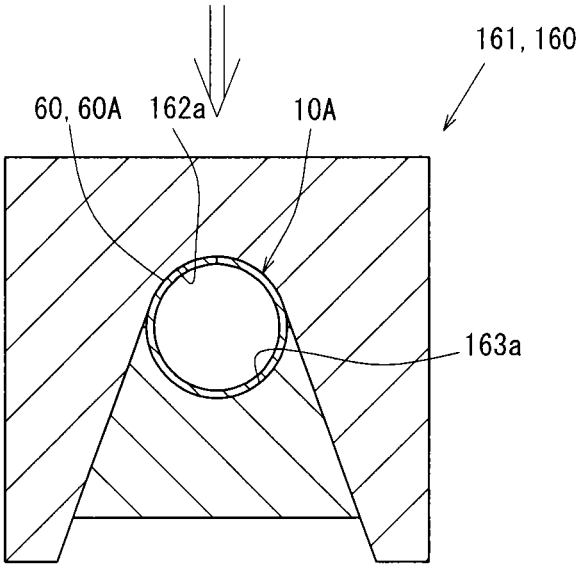

FIGS. 8A and 8B are explanatory views of a fifth terminal processing process. FIG. 9 is an orthogonal sectional view of the crimping portion corresponding part 60A showing a state of a change in the shape of the crimping portion corresponding part 60A when a shaping process is performed in a sixth terminal processing process. FIGS. 10A and 10B are explanatory views of a sixth terminal processing process. FIGS. 11A1 to 11B2 are explanatory views of a seventh terminal processing process. FIG. 11A1 is an external view of the terminal metal fitting 10A before performing the seventh terminal processing process. FIG. 11A2 is an external view of the terminal metal fitting 10A after performing the seventh terminal processing process. FIG. 11B1 is a sectional view of a transition corresponding part 40A showing a state before performing the seventh terminal processing process to the terminal metal fitting 10A. FIG. 11B2 is a sectional view of the transition corresponding part 40A showing a state that the seventh terminal processing process is being performed to the terminal metal fitting 10A.

Figure 13:
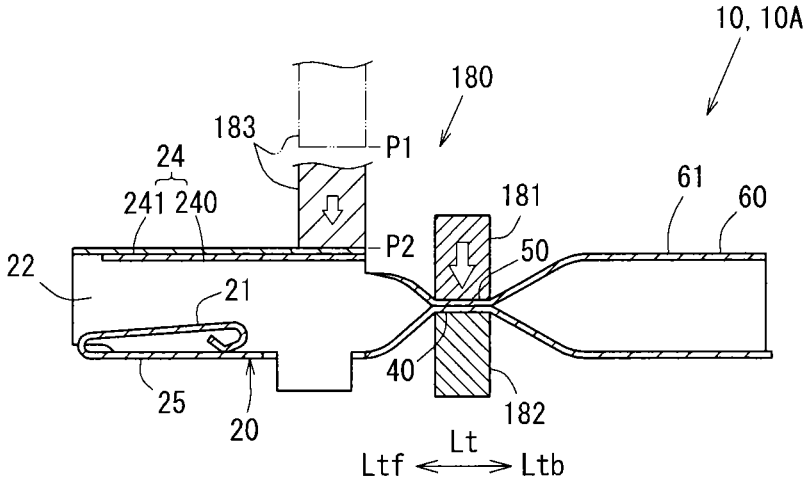
FIG. 13 is an explanatory view of the eighth terminal processing unit.
Figure 14:
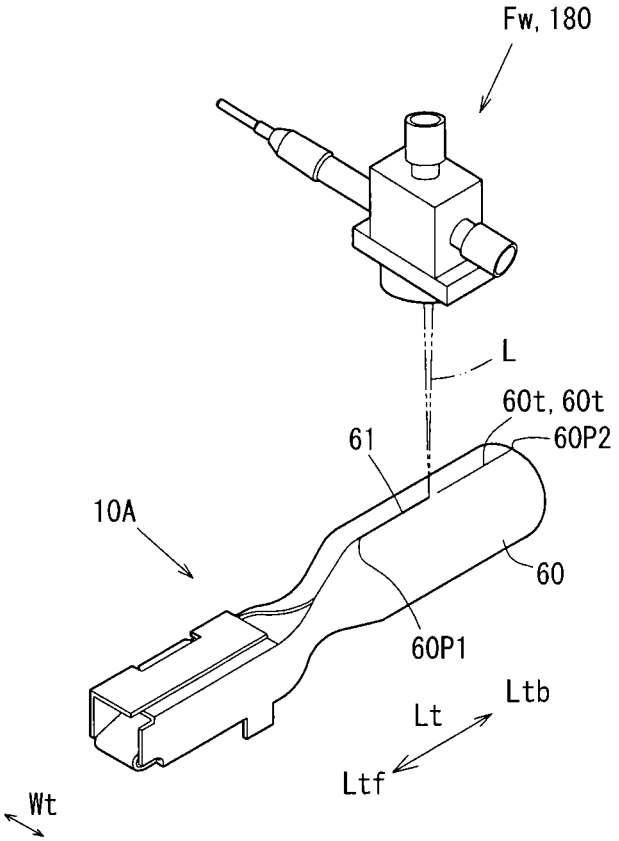
FIG. 14 is an external view showing a state of fiber laser welding.
Figures 15A, 15B:
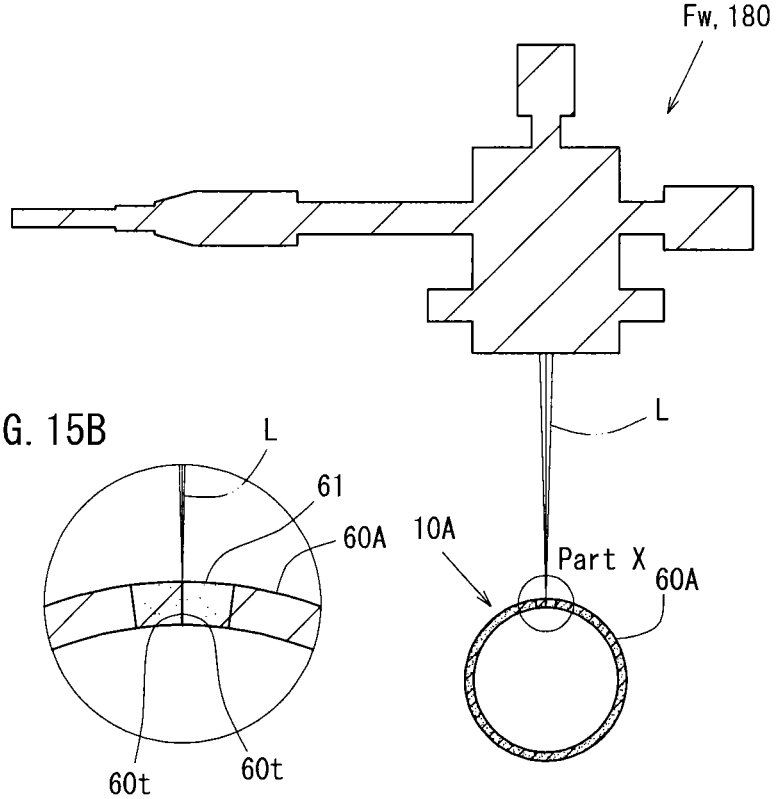
FIGS. 15A and 15B are explanatory views showing a state of fiber laser welding.

FIGS. 12A1 to 12B2 are explanatory views of an eighth terminal processing unit 180 showing by a cross section a state that an approximately cylindrical sealing portion corresponding part 50A is compressed in a flat shape. FIG. 12A1 shows a state immediately before the sealing portion corresponding part 50A is pressed by a pair of sealing portion pressing molds 181 and 182 described later. FIG. 12A2 shows an enlarged view of a part X1 in FIG. 12A1. FIG. 12B1 shows a state that the sealing portion corresponding part 50A is being pressed by the pair of sealing portion pressing molds 181 and 182. FIG. 12B2 shows an enlarged view of a part X2 in FIG. 12B1. FIG. 13 is an explanatory view of the eighth terminal processing unit 180 showing by a cross section a state that the box portion 20 is held by a box part holding jig 183. FIG. 14 is an external view showing a state of fiber laser welding in an eighth terminal processing process. FIG. 15A is an explanatory view showing by a cross section a state of the fiber laser welding. FIG. 15B is an enlarged view of a part X in FIG. 15A.

The manufacturing apparatus 1 has one terminal pre-processing unit 100 and eight terminal processing units 110 to 180 parallel-arranged in series, along the upstream side Lcu to the downstream side Lcd in the carrier longitudinal direction Lc, as units that suitably perform punching, bending, and the like to the flat-sheet shape terminal base material 300A at stages, as shown in FIG. 2 to FIG. 5.

The terminal pre-processing unit 100 and the terminal processing units 110 to 180 are arranged to be able to simultaneously process adjacent two terminal metal fittings 10A corresponding to two pitch portions, as one set, out of a plurality of terminal metal fittings 10A that are arranged at equal intervals for each predetermined pitch along the longitudinal direction of the carrier 320, as shown in FIG. 2.

In the pre-processing process to be performed by the terminal pre-processing unit 100, punching and bend processing are performed to the terminal base material 300A, as shown in FIGS. 3A, 3B1, and 3C1.

This will be described in more detail. Although not shown, the terminal pre-processing unit 100 is configured by a punching unit, and an elastic contact piece bend processing unit. The punching unit has a punching blade that punches a passing portion of the terminal base material 300A by pressing in the shape of the band-shaped terminal connection band 300, while feeding the flat-sheet shape terminal base material 300A from the upstream side. The elastic contact piece bend processing unit bend processes the elastic contact piece 21 that is extended in a tongue shape from the bottom surface part 25 of the box portion 20 to the tip side in the terminal axis direction.

Out of the flat-sheet shape terminal metal fitting 10A, a portion corresponding to the box portion 20 is set to a box-portion corresponding part 20A, a portion corresponding to the transition section 40 is set to the transition corresponding part 40A, and a portion corresponding to the crimping section 60 is set to the crimping portion corresponding part 60A. Further, out of the box portion 20, each of the bottom surface part 25, the right side surface part 22, the left side surface part 23, and the upper surface part 24 (the one side upper surface part 240, and the other side upper surface part 241) is set to a bottom-surface corresponding part 25A, a right-side surface corresponding part 22A, a left-side surface corresponding part 23A, and an upper-surface corresponding part 24A (a one-side upper surface corresponding part 240A, and the other-side upper surface corresponding part 241A), respectively. Further, a portion corresponding to the sealing portion 50 of the transition corresponding part 40A is set to a sealing portion corresponding part 50A.

In the terminal pre-processing unit 100, the punching unit and the elastic contact piece bend processing unit may be arranged separately, or may be arranged at the same position in the carrier longitudinal direction Lc. In the case of separately arranging the punching unit and the elastic contact piece bend processing unit in the carrier longitudinal direction LC, the arrangement order is not particularly limited.

The eight terminal processing units 110 to 180 are portions that mainly perform the bend processing around the terminal axis direction. As shown in FIG. 2, according to the processing contents that are performed to the terminal metal fitting 10A of the terminal connection band 300 that passed the terminal pre-processing unit 100, the terminal processing units 110 to 180 are configured by the first terminal processing unit 110, the second terminal processing unit 120, the third terminal processing unit 130, the fourth terminal processing unit 140, the fifth terminal processing unit 150, the sixth terminal processing unit 160, the seventh terminal processing unit 170, and the eighth terminal processing unit 180 arranged in this order along the upstream side to the downstream side in the carrier longitudinal direction Lc.

The processes that are performed by the first terminal processing unit 110 to the eighth terminal processing unit 180 are set to the first terminal processing process to the eighth terminal processing process, respectively.

According to the terminal processing method, mainly by the first terminal processing process to the fourth terminal processing process, a bend processing around the terminal axis direction Lt is performed to mainly the box-portion corresponding part 20A in the terminal axis direction Lt of the terminal metal fitting 10A. Mainly by the fifth terminal processing process and the sixth terminal processing process, a processing is performed to mainly the crimping portion corresponding part 60A in the terminal axis direction Lt of the terminal metal fitting 10A. By the seventh terminal processing process and the eighth terminal processing process, a processing is performed to the sealing portion corresponding part 50A.

In the first terminal processing process, the first terminal processing unit 110 raises both sides in the width direction of the flat-sheet shape box-portion corresponding part 20A, as shown in FIG. 3C2. Specifically, the first terminal processing unit 110 performs a bend processing of raising the one-side upper surface corresponding part 240A and the other-side upper surface corresponding part 241A to the bottom-surface corresponding part 25A around the terminal axis by an angle of about 60 degrees in an absolute value. The one-side upper surface corresponding part 240A is continuously connected to the right-side surface corresponding part 22A at the outside in the width direction of the box-portion corresponding part 20A. The other-side upper surface corresponding part 241A is continuously connected to the left-side surface corresponding part 23A at the outside in the width direction of the box-portion corresponding part 20A.

In the second terminal processing process, as shown in FIG. 3C3, the second terminal processing unit 120 performs a bend processing of raising the right-side surface corresponding part 22A and the left-side surface corresponding part 23A of the box-portion corresponding part 20A around the terminal axis to the bottom-surface corresponding part 25A. At the same time, as shown in FIG. 3B3, a raise processing of smoothly raising both end parts of the transition corresponding part 40A in the width direction and both end parts of the crimping portion corresponding part 60A in the width direction is performed so that the both end parts become in an arc shape.

Specifically, the second terminal processing unit 120 includes a transition pushing-up jig 121 configured by a pushing-up mold 122 and a push-up receiving mold 123, as shown in FIG. 6.

At upper and lower sides of the transition corresponding part 40A, the push-up receiving mold 123 and the pushing-up mold 122 are oppositely arranged, respectively, as shown in an upper drawing in FIG. 6. By pressurizing the pushing-up mold 122 against the transition corresponding part 40A in the state that the push-up receiving mold 123 is mounted on the upper surface of the transition corresponding part 40A, a bottom raising process of raising a whole bottom surface of the transition corresponding part 40A to the crimping portion corresponding part 60A is performed, as shown in a lower drawing in FIG. 6.

A vertical sectional view of a terminal metal fitting 10A in the lower drawing in FIG. 6 shows a sectional view along the line C-C in FIG. 3A.

Accordingly, by raising the bottom of the transition corresponding part 40A, the transition corresponding part 40A can be set to follow raise-shape deformation of the right-side surface corresponding part 22A and the left-side surface corresponding part 23A of the box-portion corresponding part 20A, and break of the transition corresponding part 40A can be avoided.

In the third terminal processing process, the third terminal processing unit 130 performs a bend processing of raising the right-side surface corresponding part 22A and the left-side surface corresponding part 23A of the box-portion corresponding part 20A to the bottom-surface corresponding part 25A until a raise angle becomes about 60 degrees in an absolute value, as shown in FIG. 4C1.

Accordingly, the one-side upper surface corresponding part 240A, the right-side surface corresponding part 22A, the other-side upper surface corresponding part 241A, and the left-side surface corresponding part 23A are bend processed in a posture of a mutually symmetrical shape at both sides of the bottom-surface corresponding part 25A in the width direction.

In the third terminal processing process, no processing is performed to the crimping portion corresponding part 60A, as shown in FIG. 4B1.

In the fourth terminal processing process, the fourth terminal processing unit 140 pressurizes the other-side upper surface corresponding part 241A from the above with a pressurizing jig not shown so that the other-side upper surface corresponding part 241A is turned to the one-side upper surface corresponding part 240A, out of the pair of the upper-surface corresponding part 240A and 241A that rise at respective sides of the bottom-surface corresponding part 25A in the box-portion corresponding part 20A, as shown in FIG. 4C2.

In the fourth terminal processing unit 140, no processing is performed to the crimping portion corresponding part 60A, as shown in FIG. 4B2.

In the fifth terminal processing process, the fifth terminal processing unit 150 bend processes so that the one side upper surface part 240 overlaps the other side upper surface part 241, as shown in FIG. 4C3. As a result, the box-portion corresponding part 20A can be formed as the box portion 20 in the cuboid shape which is long in the terminal axis direction Lt.

Further, in the fifth terminal processing process, together with the bend processing process of the box-portion corresponding part 20A, a high bending-rate processing process is performed to the crimping portion corresponding part 60A, as shown in FIGS. 4A and 4B3.

The high bending-rate processing process is a process of performing a bend processing at a bending rate higher than a bending rate for plastically deforming at least a part of a deformation portion to be plastically deformed in a predetermined bend processing shape, in the crimping portion corresponding part 60A, following the cylindrical bend processing of the crimping portion corresponding part 60A from the unprocessed shape into a cylindrical shape.

Specifically, as shown in a dashed-dotted line in FIG. 7, by forming the crimping portion corresponding part 60A in a flat-sheet shape, and from the unprocessed shape as a shape that the both end portions in the width direction are deformed in an arc shape around the terminal axis, both end portions in the width direction are finally bend processed cylindrically as shown by a two-dot chain line in FIG. 7, in the subsequent process of the fifth terminal processing process.

Before finally bend processing the crimping portion corresponding part 60A into a cylindrical shape by plastically deforming a whole of the crimping portion corresponding part 60A in the width direction into an arc shape, in the high bending-rate processing process of the fifth terminal processing process, the intermediate portion of the crimping portion corresponding part 60A in the width direction (a peripheral direction) is formed in approximately a V shape as shown by a solid line in FIG. 7 so that the intermediate portion has a high bending-rate bent portion 60*z* that is bend processed at a curvature higher than a curvature for plastically deforming the crimping portion corresponding part 60A from the unprocessed shape into a cylindrical shape.

Specifically, the high bending-rate processing process is performed by using a high bending-rate processing jig 151 as shown in FIG. 8.

The high bending-rate processing jig 151 is configured by a convex pressurizing jig 152 and a concave mold 153.

The convex pressurizing jig 152 is formed to have a convex part 152*a* that is stretched in a radially external direction as a part of the convex pressurizing jig 152 in the peripheral direction at a curvature higher than a curvature for plastically deforming the crimping portion corresponding part 60A from the unprocessed shape into a cylindrical shape. The concave mold 153 is formed in a concave shape corresponding to the convex shape of the convex part 152*a* of the convex pressurizing jig 152.

The convex pressurizing jig 152 and the concave mold 153 are arranged at higher and lower sides of the crimping portion corresponding part 60A with an interval, as shown in FIG. 8A. The convex part 152*a* in the peripheral direction of the convex pressurizing jig 152 pressurizes the crimping portion corresponding part 60A downward in the state that the convex part 152*a* opposes from the above the intermediate portion of the crimping portion corresponding part 60A in the width direction. Consequently, as shown in FIG. 8B, the crimping portion corresponding part 60A can be plastically deformed in an approximately V shape in the orthogonal sectional view, by the convex pressurizing jig 152 and the concave mold 153.

Accordingly, at the intermediate portion of the crimping portion corresponding part 60A in the width direction, it is possible to form a high bending-rate bent portion 60*z* that is bend processed at a curvature higher than a curvature for plastically deforming the crimping portion corresponding part 60A into a cylindrical shape.

In the subsequent sixth terminal processing process, the sixth terminal processing unit 160 performs a shaping process of shaping the crimping portion corresponding part 60A having an orthogonal cross section bend processed in approximately a V shape by the high bending-rate processing process, into the cylindrical crimping section 60 as shown in FIG. 5B1 and FIG. 9.

The shaping process is performed by using a shaping jig 161 as shown in FIG. 10. The shaping jig 161 is configured by a pair of external periphery shaping pressurizing molds 162 and 163.

The pair of external periphery shaping pressurizing molds 162 and 163 are respectively arranged at upper and lower sides of the crimping portion corresponding part 60A, and include concave parts 162*a* and 163*a*, respectively, that are formed in sectional semiconductor shapes having the same curvature as that of the external surface of the cylindrical crimping section 60. At the same time, the concave parts 162*a* and 163*a* move approachably and separably in a mutually opposed state.

In the shaping process, as shown in FIG. 10A, the pair of external periphery shaping pressurizing molds 162 and 163 are arranged so that the concave parts 162*a* and 163*a* are opposed to each other at upper and lower sides of the crimping portion corresponding part 60A. In this state, as shown in FIG. 10B, the crimping portion corresponding part 60A having the orthogonal cross section in approximately a V shape is press processed by one external periphery shaping pressurizing mold 162 and the other external periphery shaping pressurizing mold 163.

In this case, particularly by bending dotted portions in FIG. 9 to radially external directions in the peripheral direction of the crimping portion corresponding part 60A, the crimping portion corresponding part 60A can be finally shaped in a cylindrical shape having a predetermined curvature as the crimping section 60. The cylindrical crimping section 60 in the state that both end parts in the width direction are butted against each other in the peripheral direction can be formed (see FIG. 9).

Between the pair of external periphery shaping pressurizing molds 162 and 163, there may be provided a columnar core bar not shown that can cylindrically guide the crimping portion corresponding part 60A at the time of press processing the crimping portion corresponding part 60A by the pair of external periphery shaping pressurizing molds 162 and 163.

The sealing portion corresponding part 50A is bend processed until the sealing portion corresponding part 50A becomes an approximately U shape in the orthogonal sectional view, along the forming of the crimping section 60 in a cylindrical shape, in the sixth terminal processing process, as shown in FIG. 5B2 and FIG. 11A1.

In the subsequent seventh terminal processing process, the eighth terminal processing unit 180 shapes the sealing portion corresponding part 50A in an approximately cylindrical shape as shown in FIG. 11A2 by narrowing the sealing portion corresponding part 50A from a state shown in FIG. 11A1 to a state that the opposed end parts 60*t* become close to each other, as the pre-process of performing a sealing portion forming process.

Specifically, the seventh terminal processing unit 170 includes a sealing portion narrowing jig 171 that narrows the sealing portion corresponding part 50A approximately cylindrically, as shown in FIGS. 11B1 and 11B2. The sealing portion narrowing jig 171 is configured by a pair of external periphery shaping molds 172 and 173 at upper and lower sides, and an internal periphery shaping core bar 174.

As shown in FIG. 11B1, in the state that the internal periphery shaping core bar 174 is inserted into the arc-shaped sealing portion corresponding part 50A having a gap at an upper end in the peripheral direction, the sealing portion corresponding part 50A can be narrowed in approximately a cylindrical shape, by pressuring by the pair of external periphery shaping molds 172 and 173 arranged at the upper and lower sides as shown in FIG. 11B2.

In the eighth terminal processing process, the eighth terminal processing unit 180 forms the sealing portion 50 by compressing the approximately cylindrical sealing portion corresponding part 50A into a flat shape.

Specifically, as shown in FIG. 12A1 and FIG. 13, the eighth terminal processing unit 180 includes the pair of sealing portion pressing molds 181 and 182 that compress the sealing portion corresponding part 50A, and the box part holding jig 183 that holds the box portion 20.

The pair of sealing portion pressing molds 181 and 182 have crimping surfaces 181A and 182A having a width corresponding to the sealing portion 50, on the opposed surfaces that are respectively opposed to the sealing portion corresponding part 50A.

Out of the pair of sealing portion pressing molds 181 and 182, the upper sealing portion pressing mold 181 that is arranged at the upper side of the sealing portion corresponding part 50A has a convex part 181*a* formed at the intermediate portion of the crimping surface 181A in the width direction, that is, at portions corresponding to the opposed portions where the opposed end parts 50*t* of the sealing portion corresponding part 50A in the peripheral direction are butted against each other, as shown in FIG. 12A2. The convex part 181*a* has a tip portion formed in a mild arc shape, and is also formed by stretching downward in a stretch length of about a half of a sheet thickness of the sealing portion corresponding part 50A.

Further, the box part holding jig 183 is vertically movably configured between an evacuation position P1 where the box part holding jig 183 is evacuated to above an upper surface part 24 of the box portion 20 as indicated by a virtual line in FIG. 13, and a holding position P2 where the box part holding jig 183 holds the upper surface part 24 of the box portion 20 as indicated by a solid line in FIG. 13.

In the sealing portion forming process of the eighth terminal processing process, first, the box part holding jig 183 is lowered from the evacuation position P1 to the holding position P2. The box portion 20 is held in the state that the box part holding jig 183 is in light contact with the upper surface of the box portion 20.

In this way, in the state the box part holding jig 183 holds the box portion 20, and in the state the pair of sealing portion pressing molds 181 and 182 of the above configuration are respectively arranged at upper and lower sides of the sealing portion corresponding part 50A, by pressing the approximately cylindrical sealing portion corresponding part 50A by lowering the upper sealing portion pressing mold 181 to the lower sealing portion pressing mold 182 as shown in FIG. 12B1 and FIG. 13, predetermined portions of the sealing portion corresponding part 50A where the upper portion and the lower portion in the peripheral direction are opposed are compressed in a mutually overlapped flat shape, and can be formed as the sealing portion 50.

Out of the overlap portions that are mutually overlapped at the upper and lower sides of the sealing portion 50, the portion positioned at the upper side is set to an upper overlap portion 50*u*, and the portion positioned at the lower side is set to a lower overlap portion 50*d* (see FIG. 12B1).

In this case, when particularly the opposed portions where the opposed end parts 50*t* of the sealing portion 50 are butted against each other are focused, along the pressing of the sealing portion corresponding part 50A by the pair of sealing portion pressing molds 181 and 182, the opposed portion of the upper overlap portion 50*u* in the width direction can be securely pressed against the lower overlap portion 50*d* as compared with other portions, by the convex part 181*a* of the sealing portion pressing mold 181 arranged upper side, as shown in FIG. 12B2.

Accordingly, the upper overlap portion 50*u* and the lower overlap portion 50*d* can be kept in a securely overlapped state, without upward restoration deformation to open the one side and the other side of the upper overlap portion 50*u* of the sealing portion 50 with respect to the lower overlap portion 50*d* in the state that the sealing portion 50 is released from the pressing by the pair of sealing portion pressing molds 181 and 182.

In the eighth terminal processing process, a welding process is further performed in addition to the forming of the sealing portion 50 in the transition corresponding part 40A.

In the welding process, as shown in FIG. 14 and FIGS. 15A and 15B, in the state that the opposed end parts 60*t* of the crimping section 60 are butted against each other, the welding part 61 is formed by welding the pair of opposed end parts 60*t* together by sliding a fiber laser welding apparatus Fw provided in the eighth terminal processing unit 180, from a tip part 60P1 (a box portion 20 side) of the crimping section 60 to a base end part 60P2 (a carrier 320 side) along the terminal longitudinal direction Lt, for example.

The terminal metal fitting 10A formed in a terminal shape along the above process can be disconnected from the carrier 320 of the connection part 310 in the terminal connection band 300, not shown, and can be manufactured as the crimp terminal 10.

Performance effects that the manufacturing apparatus 1 and the manufacturing method provide will be described.

According to the above configuration, as described above, instead of directly bend processing the crimping portion corresponding part 60A from the approximately flat-sheet shape unprocessed shape into the cylindrical shape, the high bending-rate bent portion 60*z* is formed at the intermediate portion in the width direction as a part of the deformation portion to be deformed in the cylindrical shape in the crimping portion corresponding part 60A, in the fifth terminal processing process, as shown in FIG. 7. That is, the high bending-rate processing process is performed to bend process the intermediate portion at the bending rate higher than the bending rate of plastically deforming the portion from the unprocessed shape into the arc shape having a curvature corresponding to the cylindrical shape.

Further, in this state, by performing the shaping process to the crimping portion corresponding part 60A to obtain a final shape of the cylindrical shape in the sixth terminal processing process as shown in FIG. 9, the crimping portion corresponding part 60A can be plastically deformed in the state that there remains no internal stress in the direction in which the opposed end parts 60*t* which are opposed to each other in the peripheral direction are separated from each other.

Specifically, in general, a gap between the opposed end parts 60*t* of the crimping section 60 needs to be about equal to or smaller than 0.5 mm. This is because when the gap between the opposed end parts 60*t* of the crimping section 60 is larger than 0.5 mm, it becomes difficult to weld by fiber laser between the opposed portions where the opposed end parts 60*t* of the crimping section 60 are opposed.

Particularly, it is preferable that the gap between the opposed end parts 60*t* of the crimping section 60 is equal to or smaller than 0.03 mm. This is because when the gap between the opposed end parts 60*t* of the crimping section 60 is equal to or smaller than 0.03 mm, it is possible to form the welding part 61 that can securely bear the crimping of the wire tip 500T, at the opposed portions of the crimping section 60, and obtain excellent reliability of the cylindrical crimping section 60.

Figure 23A:
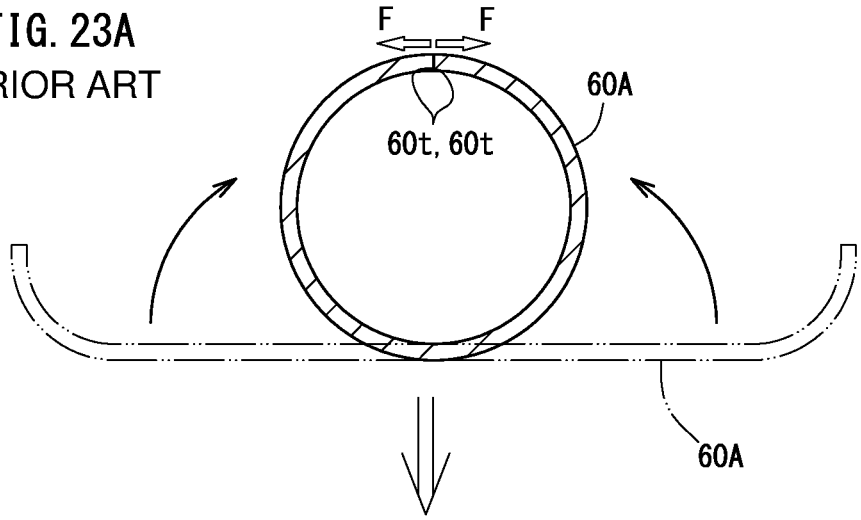
FIG. 23A PRIOR ART
FIGS. 23A and 23B are explanatory views of a conventional bend processing of a crimping section.

On the other hand, when the crimping portion corresponding part 60A is directly bend processed from the approximately flat-sheet shape unprocessed shape into the cylindrical shape as shown in FIG. 23A that shows a conventional bend-processing state of the crimping portion corresponding part 60A, outward force to separate the opposed end parts 60*t* opposed in the peripheral direction occurs even when a cylindrical bend processing is performed, due to a factor that internal stress F to restore the original unprocessed shape of the crimping portion corresponding part 60A remains, as shown by arrows F in FIG. 23.

Figure 23B:
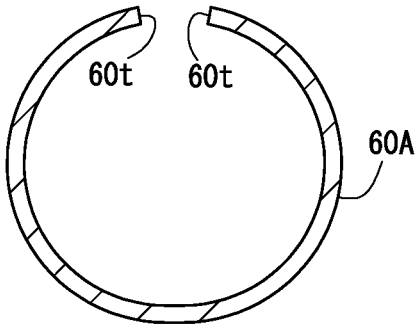
FIG. 23B PRIOR ART

Accordingly, a gap larger than 0.5 mm, for example, occurs between the opposed end parts 60*t* at the opposed portions of the crimping section 60, as shown in FIG. 23B, and it becomes difficult to irradiate fiber laser to the opposed portions in the state that the opposed portions are focused. As a result, there was a problem in the inability of securely forming the welding part 61 in the opposed portions.

On the other hand, in the present embodiment, in the high bending-rate processing process, the crimping portion corresponding part 60A is bend processed in approximately a V shape having the high bending-rate bent portion 60*z* at a curvature larger than the curvature of bend processing the crimping portion corresponding part 60A from the approximately flat-sheet shape unprocessed shape into the cylindrical shape as a final bend processing shape.

Further, in the shaping process, the opposed end parts 60*t* at both sides of the crimping section 60 in the width direction of the crimping portion corresponding part 60A after the high bending-rate processing process are butted against each other in the peripheral direction. At the same time, straight line portions having the dots in FIG. 9 provided at both sides of the intermediate portion in the width direction are bent in a radially external direction so that the straight line portions become in arc shapes. As a result, the crimping portion corresponding part 60A can be shaped from the approximately V shape into the cylindrical shape.

When cylindrically shaping the straight line portions having the dots in FIG. 9 of the crimping portion corresponding part 60A, the straight line portions are bent particularly in the arc shapes in the radially external direction. Therefore, at the portions bent in the arc-shape in the peripheral direction of the crimping section 60, the internal force F to return to the radially internal direction works in the portions bent in the arc-shape, after the cylindrical shaping.

Accordingly, inward force occurs in the crimping section 60 after the shaping process, and the opposed end parts 60*t* can be butted so that the opposed end parts 60*t* press each other.

Therefore, as described above, the crimping section 60 that is shaped processed after performing the high bending-rate processing process can have the gap between the opposed end parts 60*t* as 0.03 mm or smaller, at least equal to or smaller than 0.5 mm. Therefore, as shown in FIG. 14 and FIG. 15, in the case of irradiating fiber laser to the opposed portions, the welding can be securely performed in the state of matching the focus on between the opposed end parts 60*t*.

As described above, the high bending-rate bent portion 60*z* is formed at the intermediate portion at which the one side portion and the other side portion become in the same lengths in the width direction of the crimping portion corresponding part 60A. By this formation, in the shaping process, at the time of cylindrically shaping the crimping portion corresponding part 60A, the one side portion and the other side portion can be shaped in arc shapes in the same lengths and at the same curvature, as compared with the case where the one side portion and the other side portion are in different lengths relative to the high bending-rate bent portion 60*z*, for example. Therefore, when the crimping portion corresponding part 60A is shaped cylindrically, inward force of approximately the same magnitude can be generated in the opposed portions of the crimping section 60 so that the pair of opposed end parts 60*t* press each other in good balance.

As described above, in the second terminal processing process, the bottom raising process of raising a whole of the bottom surface of the transition corresponding part 40A to the crimping portion corresponding part 60A is also performed, as shown in FIG. 6. As a result, as described above, following the bend processing of the box-portion corresponding part 20A around the terminal axis direction Lt, breaking of the transition corresponding part 40A corresponding to the boundary portion between the box-portion corresponding part 20A and the crimping portion corresponding part 60A due to concentration of stress can be prevented.

Specifically, in the second terminal processing process, at the time of raising the right-side surface corresponding part 22A and the left-side surface corresponding part 23A of the box-portion corresponding part 20A to obtain the shapes in FIG. 3C2 to FIG. 3C3, a large bend processing is performed to the box-portion corresponding part 20A. On the other hand, substantially no deformation is forced in the crimping portion corresponding part 60A, as shown in FIG. 3B2 to FIG. 3B3.

Therefore, by the processing that involves a difference in deformation amounts due to the bend processing at each side of the terminal axis direction Lt, excessively large force is applied to the transition corresponding part 40A corresponding to a portion between the box-portion corresponding part 20A and the crimping portion corresponding part 60A, and there was a risk of occurrence of a crack.

On the other hand, in the second terminal processing process, by simultaneously raising the bottom of the transition corresponding part 40A following performance of the bend processing of the box-portion corresponding part 20A around the terminal axis direction Lt, the transition corresponding part 40A can be deformed to follow the raise shape deformation of the right-side surface corresponding part 22A and the left-side surface corresponding part 23A of the box-portion corresponding part 20A. At the same time, a difference between the deformation amount of the box-portion corresponding part 20A and the deformation amount of the crimping portion corresponding part 60A can be mitigated.

Therefore, a desired bend processing can be performed that the right-side surface corresponding part 22A and the left-side surface corresponding part 23A of the box-portion corresponding part 20A can be raised approximately vertically to the bottom-surface corresponding part 25A while preventing the occurrence of a crack due to the application of an excessively load to the transition corresponding part 40A.

Further, in the second terminal processing process, by also raising a whole bottom surface of the transition corresponding part 40A to the crimping portion corresponding part 60A, the boundary portion between the transition corresponding part 40A and the crimping portion corresponding part 60A can be set as a stage shape (see the lower drawing of FIG. 6).

Therefore, in the subsequent process of the second terminal processing process, at the time of deforming the box-portion corresponding part 20A, the stress applied to the box-portion corresponding part 20A can be prevented from being unexpectedly transmitted to the crimping portion corresponding part 60A. In the subsequent process of the second terminal processing process, the box-portion corresponding part 20A and the crimping portion corresponding part 60A can be respectively smoothly bend processed in desired shapes.

Further, in the eighth terminal processing process, at the time of pressurizing the sealing portion corresponding part 50A by the pair of sealing portion pressing molds 181 and 182, holding the box portion 20 by the box part holding jig 183 can prevent what is called a neck-break of the box portion 20 as described with reference to FIG. 13.

More specifically, at the time of pressurizing the sealing portion corresponding part 50A by the pair of sealing portion pressing molds 181 and 182, inertia force to float up by receiving the impact works on the crimp terminal 10. At this time, a position of the sealing portion 50 is restricted by the pair of sealing portion pressing molds 181 and 182.

Therefore, in the case of a conventional configuration of the eighth terminal processing unit that does not include the box part holding jig 183, there was a risk of the occurrence of what is called a neck-break of the box portion 20 that the box portion 20 is unexpectedly broken to the sealing portion 50 due to floating of the box portion 20 to the sealing portion 50 by the impact of pressing the sealing portion corresponding part 50A.

On the other hand, in the eighth terminal processing process, as shown in FIG. 13, the box portion 20 can be held down by the box part holding jig 183. Therefore, even when the sealing portion corresponding part 50A receives the impact following the pressing of the sealing portion corresponding part 50A by the pair of sealing portion pressing molds 181 and 182, the box part holding jig 183 can receive the inertia force that works to the box portion 20. Therefore, what is called a neck-break of the box portion 20 can be prevented.

Further, by holding down the box portion 20 by the box part holding jig 183, the box portion 20 is not unexpectedly deformed to the sealing portion 50. Therefore, the crimp terminal 10 excellent in accuracy in straight travelling to the terminal axis direction Lt can be formed.

Consequently, the wire tip 500T of the insulated wire 500 can be properly inserted into the crimping section 60 along the terminal axis direction Lt.

A position of the box portion 20 held down by the box part holding jig 183 is not limited to the upper surface part 24, and may be other position in the crimp terminal 10. A position other than the box portion 20 may be held down.

In the correspondence between the configuration of the present invention and the embodiment, the crimp terminal of the present invention corresponds to the terminal metal fitting 10A or the crimp terminal 10 of the embodiment, and hereinafter, similarly, the high-energy density heat source generation welding unit corresponds to the fiber laser welding apparatus Fw, but the present invention is not limited to only the configuration of the above embodiment, and can be applied based on a technical idea expressed in claims, and many embodiments can be obtained.

Further, as other embodiment, when the crimping portion corresponding part 60A is bend processed as the cylindrical crimping section 60, it is not limited to perform the high bending-rate processing process in the fifth terminal processing process and the shaping process in the sixth terminal processing process.

Figure 16A:
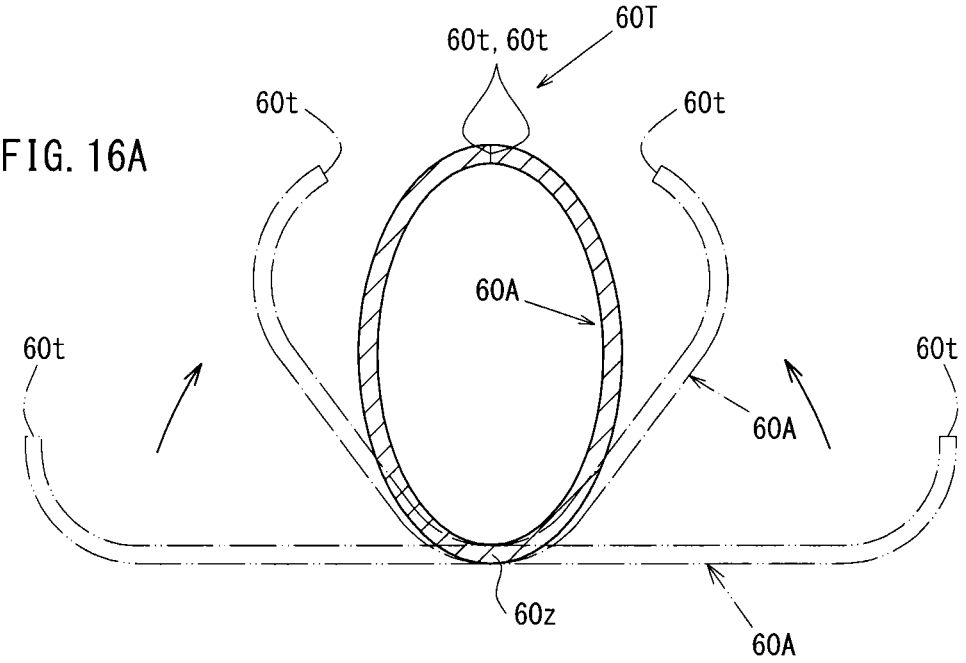
FIGS. 16A and 16B are explanatory views showing a state of a fifth terminal processing process to a sixth terminal processing process in other embodiment.

For example, the crimping portion corresponding part 60A may be bend processed as the cylindrical crimping section 60, by performing the high bending-rate processing process of bend processing the approximately flat-shaped crimping portion corresponding part 60A as shown in FIG. 3B3 until the both end parts 60*t* in the width direction are butted against each other as shown in FIG. 16A, and the shaping process of pressurizing, from the above, a butted portion 60T of the crimping portion corresponding part 60A where the both end parts 60*t* in the width direction are butted against each other.

Specifically, in the high bending-rate processing process, the approximately flat-shaped crimping portion corresponding part 60A of which the both end parts 60*t* in the width direction are raised in arc shapes (see FIG. 3B3) is bend processed over a whole periphery around intermediate portion in the width direction. The both end portions are gradually shaped in arc shapes to the intermediate portion in the width direction as shown in FIG. 16A until the both end parts 60*t* in the width direction of the crimping portion corresponding part 60A are finally butted against each other.

In the high bending-rate processing process, by performing the high bending-rate processing process to the crimping portion corresponding part 60A in this way, the crimping portion corresponding part 60A becomes an approximately upright oblong shape in the orthogonal cross section to the terminal axis direction Lt. At the intermediate portion in the width direction of the crimping portion corresponding part 60A, there is formed the high bending-rate bent portion 60*z* having a certain level of high curvature in which the both end parts 60*t* in the width direction are butted against each other.

Figure 16B:
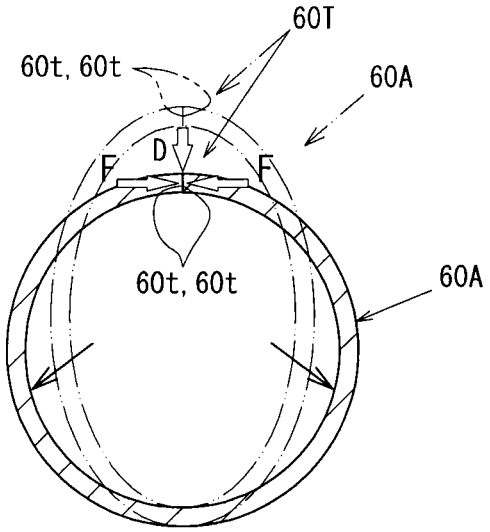

In the subsequent shaping process, by pressing downward (a radial internal direction) the butted portion 60T of the crimping portion corresponding part 60A where the both end parts 60*t* in the width direction are butted against each other as shown in FIG. 16B (see an arrow D in FIG. 16B), the crimping portion corresponding part 60A can be shaped cylindrically, and can be bend processed as the cylindrical crimping section 60.

According to the processing method of other embodiment, in the high bending-rate processing process, the high bending-rate bent portion 60*z* formed at the intermediate portion in the width direction of the crimping portion corresponding part 60A has a certain level of sufficiently high bending-rate at which the both end parts 60*t* in the width direction are butted against each other from approximately the flat shape.

Accordingly, the influence of spring back of the internal stress to separate the opposed end parts 60*t* of the cylindrical crimping section 60 can be securely canceled.

That is, by pressing downward (a radial internal direction) the butted portion 60T, the internal stress that the opposed end parts 60*t* press each other can be worked in the opposed end parts 60*t* of the crimping section 60 (see the arrow F in FIG. 16B). In the subsequent shaping process, the crimping portion corresponding part 60A can be securely cylindrically shaped.

Therefore, the crimping section 60 can be securely formed in a cylindrical shape, and at the same time, can be maintained in the state that the end parts 60*t* that are opposed in the peripheral direction are positively butted against each other.

In the high bending-rate processing process, in the above embodiment, the high bending-rate bent portion 60*z* is formed at the intermediate portion in the width direction of the crimping portion corresponding part 60A. However, as other embodiment, without limiting the formation of the high bending-rate bent portion 60*z* to a part in the width direction of the crimping portion corresponding part 60A in this way, as shown in FIG. 17A1, a whole of a crimping portion corresponding part 60PA in the width direction may be bend processed at a curvature of finally bend processing the crimping portion corresponding part 60PA into a circular shape by narrowing, that is, at a curvature higher than the curvature of the cylindrical crimping section 60 shown in FIG. 17A2.

Accordingly, in the subsequent shape processing, when shaping the crimping portion corresponding part 60PA into a circular shape as shown in FIG. 17A2, internal force can be generated in the opposed portions of the crimping section 60, and the opposed end parts 60*t* can be butted against each other.

The crimping section 60 is not limited to be bend processed into a cylindrical shape, and can be bend processed at a plurality of portions in the width direction of the crimping portion corresponding part 60A, and bend processed so that the orthogonal cross section of the crimping portion corresponding part 60A finally becomes a polygonal shape.

For example, in the case of bend processing the orthogonal cross section of a crimping portion corresponding part 60PB to finally become in a square shape, out of four bend processing parts in the width direction of the crimping portion corresponding part 60PB, predetermined two portions, for example, are bend processed at a larger angle than the right angle as a bending angle of finally forming the crimping section 60 in a square shape, and the high bending-rate bent portions 60*z* are formed at the predetermined two portions, as shown in FIG. 17B1.

Then, as shown in FIG. 17B2, in the shaping process after the high bending-rate processing process, the crimping portion corresponding part 60PB may be shaped so that the predetermined two portions where the high bending-rate bent portions 60*z* were formed respectively become at the right angle.

Accordingly, when the crimping portion corresponding part 60PB was shaped into a square shape as shown in FIG. 17B2, internal force occurs in the opposed portions of a crimping section 60B, and the opposed end parts 60*t* can be butted against each other to press each other.

Therefore, in both the crimping sections 60 and 60B shown in FIG. 17A2 and FIG. 17B2, no gap occurs in the opposed portions where the opposed end parts 60*t* are opposed each other. Consequently, the opposed portions can be securely welded.

In the manufacturing apparatus 1 in the above embodiment, the terminal pre-processing unit 100 and the terminal processing units 110 to 180 are arranged by using each two units as one set along the carrier longitudinal direction Lc (see FIG. 2). However, the configuration is not limited to this. The terminal pre-processing unit 100 and the terminal processing units 110 to 180 may be arranged by using each one unit along the carrier longitudinal direction Lc so that each one pitch can be processed to the terminal metal fitting 10A that is intermittently fed from the upstream side Lcu to the downstream side Lcd along the carrier longitudinal direction Lc, as another embodiment.

Alternatively, in the manufacturing apparatus 1, the terminal pre-processing unit 100 and the terminal processing units 110 to 180 may be arranged by using other number of units without limiting to each two units or each one unit, along the carrier longitudinal direction Lc, or may be arranged by a different arrangement number for each terminal processing unit.

As other embodiment, in the shaping process, the shaping jig 161 that is used to shape the crimping portion corresponding part 60A into a cylindrical shape is not limited to be configured by only the pair of external periphery shaping pressurizing molds 162 and 163. In addition to the external periphery shaping pressurizing molds 162 and 163, in shaping the crimping portion corresponding part 60A into a cylindrical shape, the shaping jig 161 may be configured to include an internal periphery shaping core bar for shaping the internal periphery of the crimping portion corresponding part 60A.

The internal periphery shaping core bar can be configured in a columnar shape having an external periphery surface of approximately the same curvature as that of an internal periphery surface of the cylindrical crimping section 60, though not shown.

In the case of performing the shaping process by using the shaping jig 161 that includes the internal periphery shaping core bar, the cylindrical crimping section 60 that has a smooth cylindrical internal periphery surface along the external periphery surface of the internal periphery shaping core bar can be formed, by arranging the internal periphery shaping core bar not shown in the state that the internal periphery shaping core bar is inserted into the internal space of the crimping portion corresponding part 60A having a cross section in approximately a V shape, and in this state, by press processing the crimping portion corresponding part 60A having the cross section in approximately a V shape by the external periphery shaping pressurizing molds 162 and 163 at one side and the external periphery shaping pressurizing molds 162 and 163 at the other side.

In the seventh terminal processing unit 170, the sealing portion narrowing jig 171 is configured to include the pair of external periphery shaping molds 172 and 173 and the internal periphery shaping core bar 174 as described above (see FIG. 11B1 and 11B2). However, without being limited to this, other configurations of the sealing portion narrowing jig 171 may also be employed as other embodiment.

For example, when the sealing portion corresponding part 50A can be narrowed into approximately a cylindrical shape by pressurizing the sealing portion corresponding part 50A by the pair of external periphery shaping molds 172 and 173 arranged at the upper and lower sides of the sealing portion corresponding part 50A in the state that the internal periphery shaping core bar 174 is not internally inserted, the sealing portion narrowing jig 171 may be configured by only the pair of external periphery shaping molds 172 and 173 without including the internal periphery shaping core bar 174.

The welding process of forming the welding part 61 in the pair of opposed end parts 60*t*, 60*t* of the crimping section 60 has been performed in the eighth terminal processing process. However, without being limited to this configuration, the welding process may be performed in any process so far as the welding process is a subsequent process of cylindrically shaping the crimping portion corresponding part 60A in the sixth terminal processing process, as other embodiment.

In the present embodiment, the crimp terminal 10 has been configured by the female crimp terminal that includes the box portion 20 and the crimping section 60 as described above. However, the configuration is not limited to this. So far as the crimp terminal 10 is configured to have at least the crimping section 60, the crimp terminal 10 may be configured as a male crimp terminal that includes an insertion tab that is insertion connected to the box portion 20 of other female crimp terminal in place of the box portion 20. Alternatively, the crimp terminal 10 may be configured by only the crimping section 60, and can be configured as a crimp terminal for connecting in bundle a plurality of insulated wires 500, such as conductor 510 like aluminum core wires, for example.

Figure 18A:
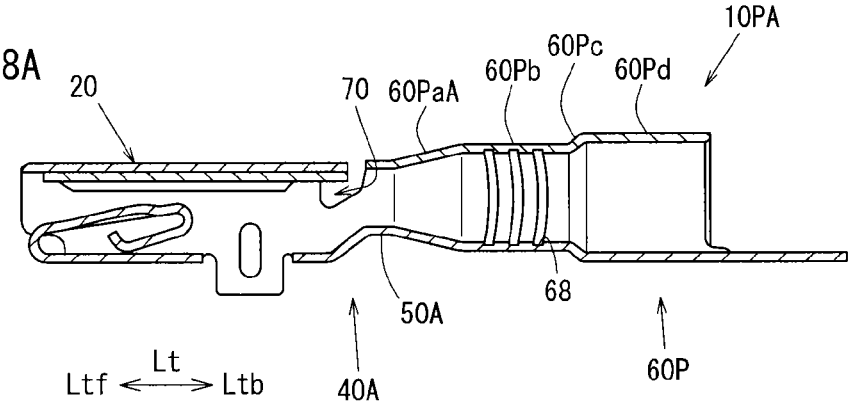
FIGS. 18A and 18B are explanatory views of a crimp terminal in other embodiment.
Figure 18B:
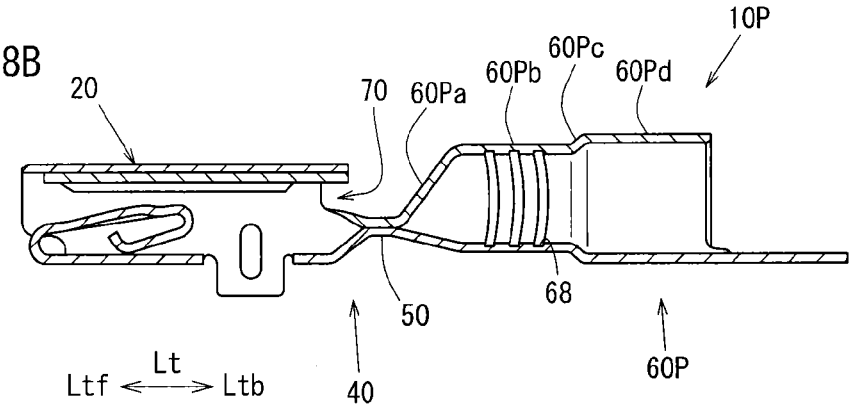

Further, as other embodiment, a crimp terminal 10P may have a notched part 70 that is notched from a base end side, on sidewalls at both sides of the terminal width direction Wt in a continuously-provided portion between the transition section 40 (the sealing portion 50) and the box portion 20, as shown in FIGS. 18A and 18B.

Figure 19:
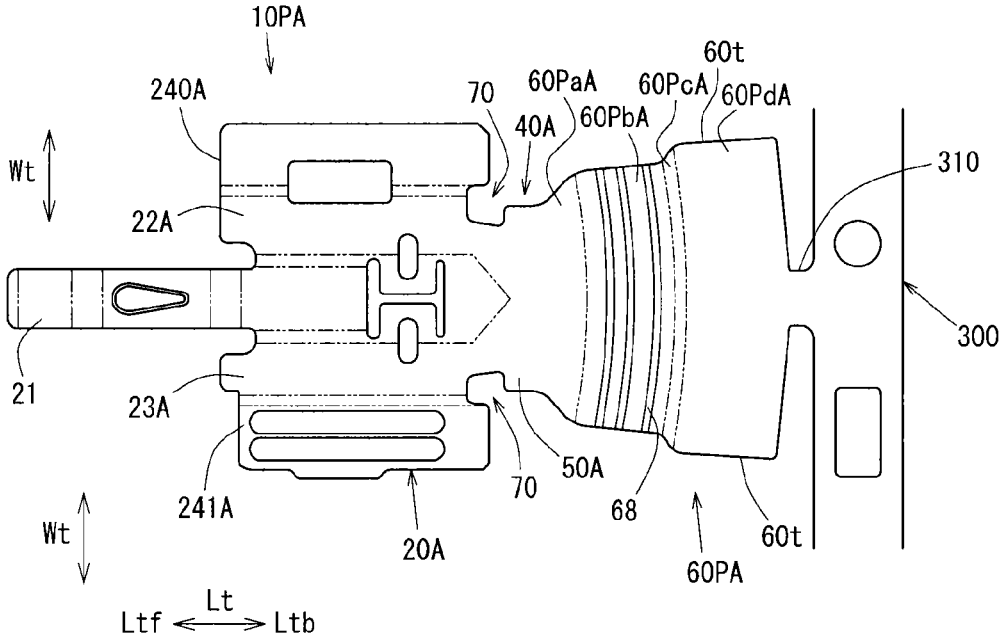
FIG. 19 is a plan view of a terminal metal fitting that has a crimp terminal developed.

The notched part 70 will be described based on the crimp terminal in a developed shape described later. As shown in FIG. 19, an external end part in the terminal width direction Wt is formed by notching, at a continuously-provided portion between the right side surface part 22A of the box-portion corresponding part 20A and the transition corresponding part 40A of the left-side surface corresponding part 23A.

In this way, by forming the notched part 70 in the continuously-provided portion between the box-portion corresponding part 20A and the transition corresponding part 40A, a secure bend processing in a desired terminal shape can be performed by keeping a whole length of the crimp terminal 10P in a terminal length that satisfies a predetermined standard of a terminal size.

Specifically, in the case of bend processing the crimp terminal 10P from the develop shape as shown in FIG. 19 into a three-dimensional shape as shown in FIG. 18B, the bend processing of the box-portion corresponding part 20A is performed in advance as shown in FIGS. 3C2 and 3C3 and FIGS. 4C1 and 4C2. At a stage where the bend processing of the box-portion corresponding part 20A is approximately completed, the bend processing of the crimping portion corresponding part 60A is mainly performed as shown in FIG. 4B3 and FIGS. 5B1, 5B2, and 5B3.

Therefore, due to a difference between the deformation amount of the box-portion corresponding part 20A and the deformation amount of the crimping portion corresponding part 60A following the respective bend processings in each process, excessive stress is applied to the transition corresponding part 40A corresponding to the part between the box-portion corresponding part 20A and the crimping portion corresponding part 60A. Among others, particularly because rapid bend deformation is forced in the boundary portion between the box-portion corresponding part 20A and the transition corresponding part 40A, there has been a risk of the occurrence of a crack in the boundary portion due to concentration of stress in the boundary portion.

On the other hand, as a measure for dispersing the stress applied in concentration following the rapid bend deformation in the boundary portion between the box-portion corresponding part 20A and the transition corresponding part 40A, it can be considered to form the transition corresponding part 40A long.

However, when the transition corresponding part 40A is formed long, a total length of the crimp terminal 10P also becomes long accordingly. As a result, the crimp terminal 10P becomes of a terminal length that does not satisfy the predetermined standard, and there arises a separate problem that the crimp terminal 10P cannot be properly inserted into a terminal insertion hole of the connector not shown.

On the other hand, according to the crimp terminal 10P of the present embodiment, by forming the notched part 70 in the continuously-provided portion between the box-portion corresponding part 20A and the transition corresponding part 40A, the excessive stress that works due to the difference in the deformation amount in the boundary portion in the process of bend processing the box-portion corresponding part 20A can be also dispersed to the continuously-provided portion having the notched part 70.

Accordingly, concentration of stress in the boundary portion in the process of bend processing the box-portion corresponding part 20A can be prevented, and the crimp terminal 10P can be formed in a desired length.

Further, in the crimp terminal 10P of the present embodiment, since the notched part 70 is formed in the continuously-provided portion between the box-portion corresponding part 20A and the transition corresponding part 40A, stress concentration applied to the transition corresponding part 40A can be mitigated at the time of bend processing the box-portion corresponding part 20A, without forming the transition corresponding part 40A itself long.

Therefore, because a whole length of the crimp terminal 10P can be maintained in the terminal length that satisfies the predetermined standard, a whole length of the crimp terminal 10P can be maintained in the terminal length that satisfies the predetermined standard such as a length in which the crimp terminal 10P can be properly inserted into the terminal insertion hole of the connector.

Figure 20:
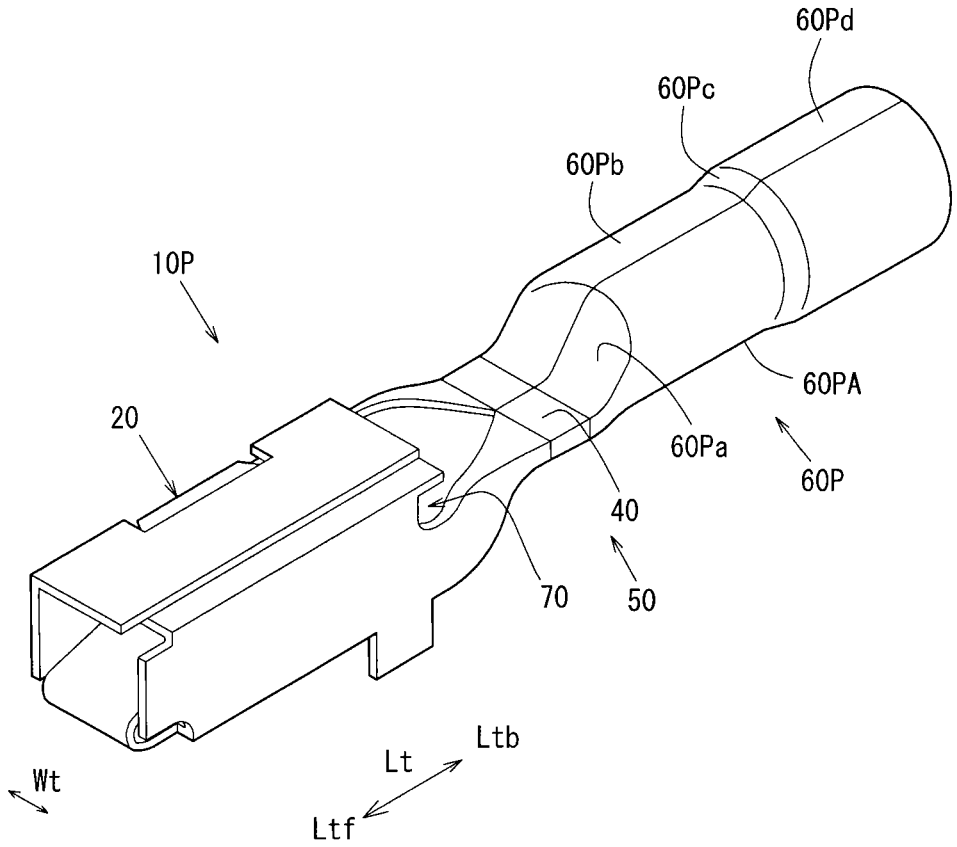
FIG. 20 is a configuration explanatory view of a crimp terminal according to other embodiment.

As other embodiment, the crimp terminal 10P may be formed such that a crimping section 60P is in a staged shape having different diameters in the terminal axis direction Lt, as shown in FIG. 20, without being formed in the same diameter along the terminal axis direction Lt.

FIG. 20 shows a perspective view of the crimp terminal 10P in the other embodiment.

Specifically, the crimping section 60P is integrally configured by a tip-side open block part 60Pa, a conductor crimping section 60Pb, a step 60Pc, and a cover crimping section 60Pd.

The conductor crimping section 60Pb is a portion corresponding to the conductor tip 510T that is inserted in the terminal axis direction Lt in the state that the wire tip 500T is inserted. The conductor crimping section 60Pb is formed to have an internal diameter approximately equal to or slightly larger than the external diameter of the conductor tip 510T, and in a diameter smaller than the external diameter of the cover crimping section 60Pd.

The cover crimping section 60Pd is a portion corresponding to the conductor tip 520T that is inserted in the terminal axis direction Lt in the state that the wire tip 500T is inserted. The cover crimping section 60Pd is formed to have an internal diameter approximately equal to or slightly larger than the external diameter of the conductor tip 520T.

The step 60Pc between the conductor crimping section 60Pb and the cover crimping section 60Pd of the crimping section 60P is not in a step shape that is orthogonal with the terminal axis direction Lt, and is formed in a step shape in which a diameter smoothly reduces from the cover crimping section 60Pd toward the conductor crimping section 60Pb.

The tip-side open block part 60Pa is a portion where the tip side of the cylindrical crimping section 60P in the terminal axis direction Lt is blocked not be opened.

Figure 21A:
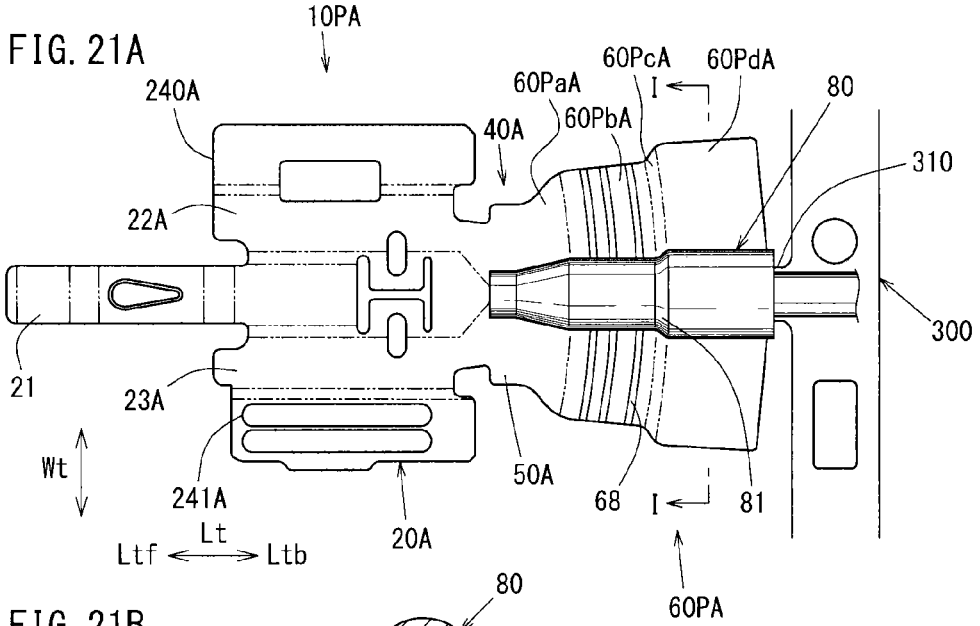
FIGS. 21A to 21C are explanatory views for explaining a manufacturing method of a crimp terminal according to other embodiment.
Figure 21B:
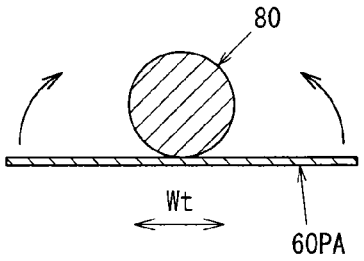
Figure 21C:
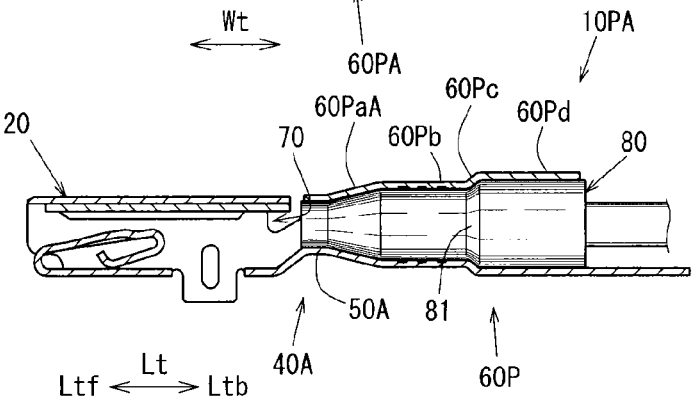

The above crimp terminal 10P is manufactured as shown in FIGS. 21A, 21B, and 21C by using a stepped core bar 80 to a terminal metal member 10PA as shown in FIG. 19.

FIG. 21A is a plan view of the terminal metal member 10PA, and shows a plan view of a state that a core bar 600 is arranged in the crimping portion corresponding part 60PA of the terminal metal member 10PA. FIG. 21B shows a sectional view of an arrow I-I in FIG. 21A. FIG. 21C shows a vertical sectional view of a state that the crimping portion corresponding part 60PA is cylindrically formed.

Specifically, the terminal metal member 10PA has the box-portion corresponding part 20A, the transition corresponding part 40A, and the crimping portion corresponding part 60PA arranged in this order along the tip side Ltf to the base end side Ltb in the terminal axis direction Lt, as shown in FIGS. 19 and 21A.

The sealing portion corresponding part 50A is arranged in the back side portion of the transition corresponding part 40A in the terminal axis direction Lt. A tip-side opening block corresponding part 60PaA corresponding to the tip-side open block part 60Pa before processing, a conductor crimping portion corresponding part 60PbA corresponding to the conductor crimping section 60Pb before processing, a step-portion corresponding part 60PcA corresponding to the step 60Pc before processing, and a cover crimping portion corresponding part 60PdA corresponding to the cover crimping section 60Pd before processing are arranged in the crimping portion corresponding part 60PA, in this order, along the tip side Ltf to the base end side Ltb in the terminal axis direction Lt.

As shown in FIG. 19, the tip-side opening block corresponding part 60PaA is formed to become gradually small along the base end side Ltb to the tip side Ltf in the terminal axis direction Lt to make it possible to continuously provide the crimping portion corresponding part 60PA and the sealing portion corresponding part 50A.

The step-portion corresponding part 60PcA corresponds to the step 60Pc, and is formed by inclining the external edge part in the width direction to the terminal axis direction Lt to become gradually in a small width along the base end side Ltb to the tip side Ltf in the terminal axis direction Lt according to respective sizes of the conductor crimping portion corresponding part 60PbA and the cover crimping portion corresponding part 60PdA.

Further, the cover crimping portion corresponding part 60PdA and the conductor crimping portion corresponding part 60PbA are also formed by inclining the external edge parts in the respective width directions to the terminal axis direction Lt to become gradually in small widths along the base end side Ltb to the tip side Ltf in the terminal axis direction Lt.

In addition, the base end side end part of the crimping portion corresponding part 60PA is formed by inclining the external portion in the terminal width direction Wt to the terminal width direction Wt with respect to the connection part 310 provided in the intermediate portion in the terminal width direction Wt, so that an interval from the carrier 320 in the terminal axis direction Lt gradually spreads.

On the other hand, the external end parts at both sides of the sealing portion corresponding part 50A in the terminal width direction Wt are formed in parallel without inclination to the terminal axis direction Lt.

Serrations 68 (engagement grooves) are formed in the conductor crimping portion corresponding part 60PbA. The serrations 68 are formed over a whole length of the terminal width direction Wt of the conductor crimping portion corresponding part 60PbA, and are also formed in bow shapes in a plan-view such that a center portion relative to outside in the terminal width direction Wt is gradually curved to the base end side in the terminal width direction Wt.

The above crimp terminal 10P can be manufactured by bend processing by using the stepped core bar 80 to the terminal metal member 10PA in the fifth terminal processing process to the sixth terminal processing process.

Specifically, as shown in FIG. 21, the stepped core bar 80 is arranged from the sealing portion corresponding part 50A to the crimping portion corresponding part 60PA along the axis terminal direction Lt of the intermediate portion in the terminal width direction Wt of the sealing portion corresponding part 50A of the terminal metal member 10PA and the crimping portion corresponding part 60PA.

In this case, a step portion 81 of the stepped core bar 80 and the step-portion corresponding part 60PcA of the crimping portion corresponding part 60PA are arranged in a positioned state in the terminal axis direction Lt.

In this state, portions of the sealing portion corresponding part 50A and the crimping portion corresponding part 60PA are cylindrically bend processed along the external peripheral surface of the stepped core bar 80 so that the stepped core bar 80 is surrounded by the sealing portion corresponding part 50A and the crimping portion corresponding part 60PA by suitably pressurizing from the outside by a pressuring mold not shown.

In this case, particularly as shown in FIGS. 21A, 21B, and 21C, the sealing portion corresponding part 50A and the crimping portion corresponding part 60PA surround the stepped core bar 80 by bringing the bow-shaped step-portion corresponding part 60PcA into contact with the external peripheral surface of the step portion 81 of the stepped core bar 80.

By the above process, the crimp terminal 10P having the crimping section 60P formed in a step shape can be formed.

Figure 24:
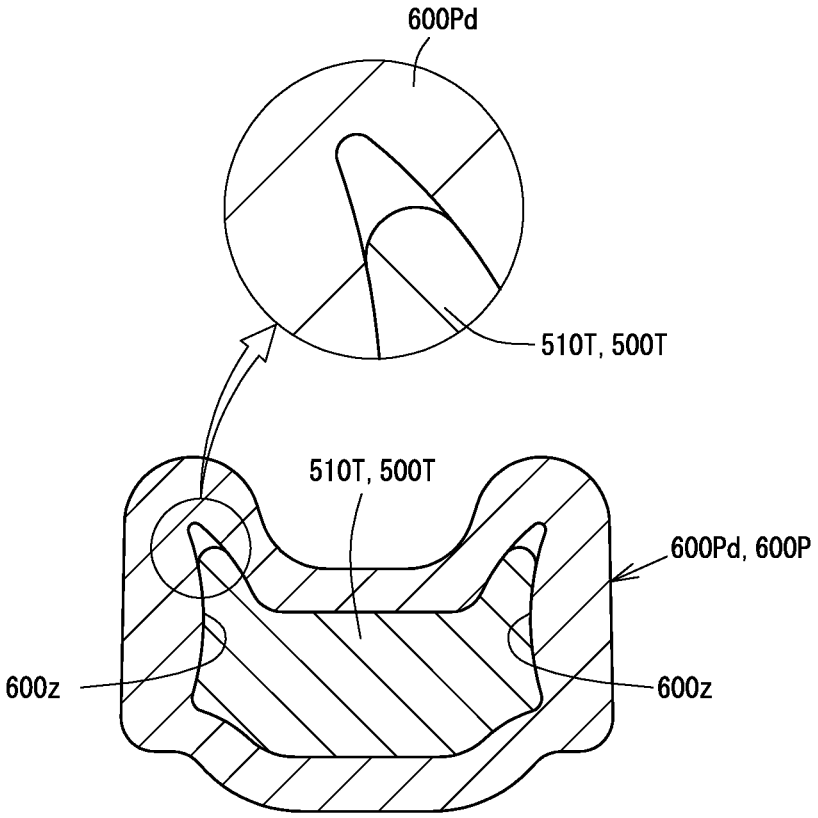
FIG. 24 PRIOR ART
FIG. 24 is a sectional view of a conventional conductor crimping section of a crimp terminal.

Hereinafter, effects of the crimp terminal 10P having the crimping section 60P formed in a step shape will be described with reference to FIG. 22 and FIG. 24.

Figure 22:
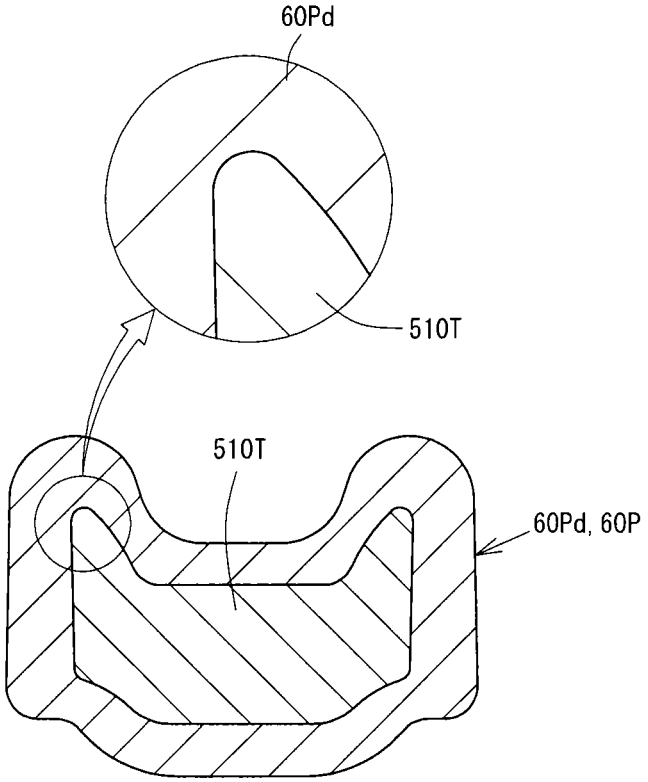
FIG. 22 is a sectional view of a conductor crimping section of a crimp terminal according to other embodiment.

FIG. 22 shows a sectional view of the conductor crimping section 60Pb after a crimping connection process when the crimping section 60P is formed in a step shape. FIG. 24 shows a sectional view of the conventional conductor crimping section 600Pd when the crimping section 600 is not formed in a step shape.

In the case of the crimping section 60P formed in the step shape, a gap between the conductor crimping section 60Pb and the conductor tip 510T becomes small compared with that of the conventional conductor crimping section 600Pd of the crimping section 600P which is not formed in a step shape. Therefore, a compression amount to inside in the radial direction at the time of crimp connecting the conductor crimping section 60Pb to the conductor tip 510T can be suppressed, and the occurrence of an excess fillet can be prevented.

Therefore, the conductor crimping section 60Pb can be closely contacted to the conductor tip 510T, and water-blocking performance inside the crimping section 60P can be improved.

More specifically, the conventional crimping section 600 that is not formed in a step shape has a larger gap between the conductor crimping section 60Pb and the conductor tip 510T than a gap in the crimping section 60P formed in a step shape according to the present embodiment. Therefore, a deformation amount to inside in the radial direction at the time of crimp connecting the conductor crimping section 60Pb to the conductor tip 510T becomes larger.

Accordingly, in the case of the conventional conductor crimping section 600Pb, an excess fillet occurs at the time of crimp connecting the conductor crimping section 600Pb to the conductor tip 510T. As a result, as shown in FIG. 24, what is called an inside-fall portion 600*z* that the excess fillet falls like expanding to inside in the radial direction occurs.

When the inside-fall portion 600*z* occurs in the crimping section 60, the inside-fall portion 600*z* becomes an obstacle at the time of crimp connecting to the wire tip 500T, and the conductor tip 510T does not reach the corner of the internal space of the conductor crimping section 60Pb. Therefore, there has been a risk that a gap occurs between the conductor crimping section 60Pb and the conductor tip 510T, as shown by a partially enlarged view in FIG. 24.

That is, in the case of the conventional crimping section 600P that is not formed in a step shape, adhesion property between the conductor crimping section 600Pb and the conductor tip 510T reduces when the conventional crimping section 600P is crimp connected to the wire tip 500T. Therefore, there has been a problem in that a desired electric characteristic cannot be obtained due to the entrance of the water content inside by the capillary phenomenon and the like.

On the other hand, in the case of the crimping section 60P that is formed in a step shape according to the present embodiment, a gap between the conductor crimping section 60Pb and the conductor tip 510T can be made small in the state that the wire tip 500T is inserted, as compared with the crimping section 600P that is not formed in a step shape.

Therefore, when the crimping section 600P is crimp connected to the wire tip 500T, the inside-fall portion 600*z* does not occur in the conductor crimping section 60Pb. The conductor crimping section 60Pb and the conductor tip 510T can be crimped in a close contact state, and an excellent electric characteristic can be obtained.

Further, the step 60Pc of the crimping section 60P is formed in a step shape by smoothly reducing the diameter from the cover crimping section 60Pd to the conductor crimping section 60Pb. Therefore, at the time of inserting the wire tip 500T into the crimping section 60P, the raw wires that configure the conductor tip 510T are not scattered due to the conductor tip 510T being caught by the step part 60Pc. The wire tip 500T can be smoothly inserted deep into the crimping section 60P.

The sealing portion corresponding part 50A and the crimping portion corresponding part 60PA are bend processed to surround the core bar 80 in the state of being positioned in the terminal axis direction Lt in such a manner that the step-portion corresponding part 60PcA formed in a bow shape in the plan view is pressed against the external surface of the step portion 81 of the stepped core bar 80.

Accordingly, in the state that the crimping portion corresponding part 60PA is bend processed as the crimping section 60P, the step part 60Pc can be securely formed in the step-portion corresponding part 60PcA without causing the step part 60Pc to be positionally deviated in the terminal axis direction Lt.

Therefore, even when the crimp terminal 10P is manufactured by a large amount, the step part 60Pc can be formed at a predetermined position without a variation of the step part 60Pc in the terminal axis direction Lt of the crimping section in each crimp terminal 10P.

More specifically, for example, due to a deviation of the formation position of the step part 60Pc in the terminal axis direction Lt of the crimping section 60P, when the conductor crimping section 60Pb is formed longer than a desired length in the terminal axis direction Lt, because the conductor crimping section 60Pb is formed in a smaller diameter than that of the cover crimping section 60Pd, there has been a risk that in the middle of the insertion of the wire tip 500T into the crimping section 60P, the tip of an insulating cover tip part 211 is caught by the step part 60Pc of the crimping section 60P, the wire tip 500T cannot be securely inserted deep into the crimping section 60P, and a space in which the conductor tip 510T cannot be inserted inside the conductor crimping section 60Pb. Accordingly, there has been a risk that a gap is formed inside the conductor crimping section 60Pb when the crimping section 60P and the wire tip 500T are crimp connected together.

Conversely, due to a deviation of the formation position of the step part 60Pc in the terminal axis direction Lt of the crimping section, when the cover crimping section 60Pd is formed longer than a desired length in the terminal axis direction Lt, there has been a risk that at the time of inserting the wire tip 500T into the crimping section 60P, inside the crimping section 60P, the wire tip 500T is kept being inserted until the conductor tip 510T is butted against the wall surface at the tip side of the crimping section 60P or even after the conductor tip 510T is butted against the wall surface at the tip side of the crimping section 60P. Accordingly, there has been a risk that the tip of the conductor tip 510T is bent.

When the cover crimping section 60Pd is formed longer than a desired length in the terminal axis direction Lt, the cover crimping section 60Pd is positioned around a base end side Xb of the conductor tip 510T, even when the wire tip 500T is inserted by a proper insertion amount inside the crimping section.

Because the gap between the conductor tip 510T and the cover crimping section 60Pd is larger than the gap between the conductor tip 510T and the conductor crimping section 60Pb, when the wire tip 500T and the crimping section 60P are crimp connected to each other, there has been a risk that what is called the inside-fall portion 600*z* is formed in the crimping section 60P at the base end side Xb of the conductor tip 510T.

On the other hand, according to the crimp terminal 10P of the present embodiment, the step part 60Pc is formed at a desired position in the terminal axis direction Lt of the crimping section 60P by using the stepped core bar 80. Therefore, the wire tip 500T can be smoothly inserted into the crimping section 60P by a proper insertion amount.

Therefore, wires with a terminal having a satisfactory electric connection characteristic can be efficiently manufactured, by crimp connecting the crimping section 60P to the wire tip 500T in a close contact state.

Further, as shown in FIG. 19, in the state of the terminal metal member 10PA before the crimp terminal 10P is bend processed, the crimp terminal 10P of the present embodiment is formed by inclining the external end parts at both sides in the terminal width direction Lw of the crimping portion corresponding part 60PA, more specifically, the tip-side opening block corresponding part 60PaA, the conductor crimping portion corresponding part 60PbA, the step-portion corresponding part 60PcA, and the cover crimping portion corresponding part 60PdA, to the terminal axis direction Lt so that the external end parts become gradually smaller along the base end side Ltb to the tip side Ltf in the terminal axis direction Lt, as described above.

Further, the base end side end part of the crimping portion corresponding part 60PA is also formed by inclining the external portion in the terminal width direction Wt to the connection part 310 at the intermediate portion in the terminal width direction Wt, to the terminal width direction Wt so that an interval from the carrier 320 gradually spreads along the outside in the in the terminal width direction Wt.

The crimping portion corresponding part 60PA can be formed, by forming the external peripheral edge in the above shape, by compression based on pressurizing of the pressurizing mold, not shown, used at the time of cylindrical bend processing, considering extension of the material generated in the crimping portion corresponding part 60PA.

Accordingly, by compression based on pressurizing of the pressurizing mold used at the time of cylindrical bend processing, in the state that the sealing portion corresponding part 50A and the crimping portion corresponding part 60PA are bend processed as the sealing portion 50 and the crimping section 60P, respectively, the end parts 60*t* that are opposed in the peripheral direction can be butted against each other without a gap along the terminal axis direction Lt. The stepped crimping section 60P including the conductor crimping section 60Pb and the cover crimping section 60Pd can be securely formed.

In the manufacturing of the crimp terminal 10PA including the crimping section 60P having the step 60Pc, by considering the spring back of the crimping section 60P, after once performing the high bending-rate processing process, the shaping process may be performed to perform a cylindrical bend processing.

The insulated wire 500 that is connected to the crimp terminals 10 and 10P is not limited to only covering the conductor 510 of a copper system made of aluminum or an aluminum alloy with the insulating cover 520. The insulated wire 500 may be provided by covering the conductor 510 of a copper system made of copper or a copper alloy with the insulating cover 520, for example. The conductor 510 may be a dissimilar mixed conductor obtained by bundling by arranging aluminum raw wires around copper system raw wires, or may be a dissimilar mixed conductor obtained by bundling by arranging copper system raw wires around aluminum raw wire.

DESCRIPTION OF REFERENCE SIGNS

1: Manufacturing apparatus
10, 10P: Crimp terminal
10A, 10PA: Terminal metal member
60, 60B, 60P Crimping section
60A, 60PA, 60PB: Crimping portion corresponding part
150: Fifth terminal processing unit
151: High bending-rate processing jig
160: Sixth terminal processing unit
161: Shaping jig
180: Eighth terminal processing unit
300A: Terminal base material Fw: Fiber laser welding device

The invention claimed is:

1. A cylindrical body obtained by bend processing at least a part of a bend processing portion of a sheet member into a cylindrical shape, wherein at an external portion of the bend processing portion in a thickness direction, internal stress of pulling outward in a peripheral direction works, and at an internal portion in a thickness direction, internal stress of compressing inward in the peripheral direction works.

2. A crimp terminal that has a connection part to be connected to a connection other-side member, a transition section for joining the connection part and a crimping section, and the crimping section, arranged in this order, from a tip side to a base side in a terminal axis direction, and has the transition section formed by raising a bottom to the connection part and the crimping section.

3. The crimp terminal according to claim 2, wherein a welding part that is fixed along the terminal axis direction by welding, by a high-energy density heat source, both ends in a peripheral direction of the crimping section that is cylindrically bend processed by a terminal bend processing unit is formed at the both ends.

4. A sheet-shaped terminal metal fitting in a pre-bend processing state of the crimp terminal according to claim 2 or 3, the terminal metal fitting comprising a cylindrical crimping section which crimps a conductor tip having an insulating cover peeled off at least at a tip side of an insulated wire which covers a conductor with the insulating cover, and a sealing portion for sealing an opening part of the crimping section at a tip side in the terminal axis direction, wherein the crimping section comprises a conductor crimping section that crimps the conductor tip, a cover crimping section that crimps the conductor tip, and a step that is present between the conductor crimping section and the cover crimping section, a crimping portion corresponding part which corresponds to the crimping section before a bend processing is formed in a width corresponding to an external peripheral shape of each of the conductor crimping section, the step, and the cover crimping section, along a base end side to a tip side in a terminal axis direction, and is also formed so that an external end part in a width direction becomes an inclined shape to the terminal axis direction so as to be gradually in a small width, and a sealing portion corresponding part which corresponds to the sealing portion before the bend processing is formed in a width corresponding to an external peripheral shape of the sealing portion, and is also formed so that an external end part in a width direction becomes approximately parallel to the terminal axis direction.

5. A wire harness comprising a plurality of crimping connection structural bodies that have the crimping section in the crimp terminal according to claim 2 or 3 crimp connected by swaging, to a conductor tip which has a conductor exposed by peeling off an insulating cover at least at a tip side of an insulated wire covering the conductor with the insulating cover, and also comprising a connector housing which can house the crimp terminal in a connection structural body, wherein the crimp terminal is arranged in the connector housing.

6. A sheet-shaped terminal metal fitting in a pre-bend processing state of a crimp terminal, the terminal metal fitting comprising: a connection part to be connected to a connection other-side member; a cylindrical crimping section which crimps a conductor tip having an insulating cover peeled off at least at a tip side of an insulated wire which covers a conductor with the insulating cover; and a transition section for joining the connection part and the crimping section, from a tip side to a base side in a terminal axis direction, wherein the crimping section is bend processed into a cylindrical shape and is formed so that the end parts of the crimping section are butted against each other without a gap along the terminal axis direction, the end parts being opposed in a peripheral direction, the crimping section comprising: a sealing portion for sealing the cylindrical crimping section at a tip side; a conductor crimping section that crimps the conductor tip; a cover crimping section that crimps the conductor tip; and a step that is interposed between the conductor crimping section and the cover crimping section, a crimping section corresponding part which corresponds to the crimping section before a bend processing is formed with a width corresponding to an external peripheral shape of each of the conductor crimping section, the step, and the cover crimping section along a base end side to a tip side in a terminal axis direction, and is also formed so that an external end part in a width direction becomes an inclined shape to the terminal axis direction so as to be gradually narrowed in width, and the base end side end part of the crimping section corresponding part in the axis direction is formed by inclining the external end part in a terminal width direction with respect to the terminal width direction so that the external end part approaches a connection part side.

7. A terminal metal fitting according to claim 6, wherein the crimping section corresponding part includes a conductor crimping section corresponding part corresponding to the conductor crimping section and a cover crimping section corresponding part corresponding to the cover crimping section, and the cover crimping section corresponding part and the conductor crimping section corresponding part are formed so that an external end part in a width direction becomes an inclined shape to the terminal axis direction along the base end side to the tip side so as to be gradually narrowed in width.

8. A terminal metal fitting according to claim 7, wherein a serration is formed in a bow shape in a plan-view such that a center portion relative to outside in the width direction is gradually curved to the base end side in an inner surface of the conductor crimping section corresponding part.

9. A terminal metal fitting according to claim 6, wherein a sealing portion corresponding part which corresponds to the sealing portion is formed on a tip side of the crimping section corresponding part, and the sealing portion corresponding part is formed so that an external end part of the sealing portion corresponding part in a width direction becomes parallel to the terminal axis direction.

10. A terminal metal fitting according to claim 6, wherein the terminal metal fitting has a notched part that is formed by notching an external end part in the width direction on sidewalls at both sides of the width direction in a continuously-provided portion between the connection part and the transition section.

11. A crimp terminal formed by bend processing the terminal metal fitting according to claim 6, the crimp terminal comprising: a connection part to be connected to a connection other-side member; a cylindrical crimping section which crimps a conductor tip having an insulating cover peeled off at least at a tip side of an insulated wire which covers a conductor with the insulating cover; and a transition section for joining the connection part and the crimping section, from a tip side to a base side in a terminal axis direction.

12. A wire harness comprising a plurality of crimping connection structural bodies that have the crimping section in the crimp terminal according to claim 11 crimp connected by swaging, to a conductor tip which has a conductor exposed by peeling off an insulating cover at least at a tip side of an insulated wire covering the conductor with the insulating cover, and also comprising a connector housing which can house the crimp terminal in the connection structural body, wherein the crimp terminal is arranged in the connector housing.

* * * * *